US010933670B2

(12) United States Patent
Kobayashi

(10) Patent No.: US 10,933,670 B2
(45) Date of Patent: Mar. 2, 2021

(54) LIQUID EJECTING APPARATUS

(71) Applicant: SEIKO EPSON CORPORATION, Tokyo (JP)

(72) Inventor: Haruki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/693,868

(22) Filed: Nov. 25, 2019

(65) Prior Publication Data

US 2020/0171863 A1 Jun. 4, 2020

(30) Foreign Application Priority Data

Nov. 29, 2018 (JP) ..... JP2018-223233
Sep. 13, 2019 (JP) ..... JP2019-166967

(51) Int. Cl.
*B41J 25/34* (2006.01)

(52) U.S. Cl.
CPC ..... *B41J 25/34* (2013.01)

(58) Field of Classification Search
CPC ..... B41J 25/34; B41J 2/14274; B41J 2002/14362; B41J 2/16517; B41J 2/16535; B41J 2/14201; B41J 2/04581; B41J 11/00
USPC ..... 347/37
See application file for complete search history.

(56) References Cited

U.S. PATENT DOCUMENTS 8,500,245 B2 8/2013 Hagiwara et al.
8,567,906 B2 10/2013 Shinozaki
9,061,497 B2 6/2015 Okubo
2008/0309425 A1* 12/2008 Sugita ..... B41J 2/04541 333/12
2011/0242190 A1* 10/2011 Suzuki ..... B41J 2/055 347/20
2012/0069090 A1 3/2012 Shinozaki
2012/0147094 A1 6/2012 Hagiwara et al.
(Continued)

FOREIGN PATENT DOCUMENTS

JP H05-221063 8/1993
JP 2005-096367 A 4/2005
JP 2006-272885 10/2006
(Continued)

*Primary Examiner* — Huan H Tran
*Assistant Examiner* — Alexander D Shenderov
(74) *Attorney, Agent, or Firm* — Workman Nydegger

(57) ABSTRACT

The liquid ejecting apparatus includes a liquid ejecting head ejecting liquid in a first-direction and a transport unit transporting a medium in either a second-direction or a third-direction, in which the liquid ejecting head includes a nozzle plate, a case head provided in a fourth-direction with respect to the nozzle plate and having a support surface on the fourth-direction-side thereof, a circuit substrate supported on the support surface, a holder provided in the fourth-direction with respect to the circuit substrate, and a first-screw fixing the case head and the holder, the case head includes a case main body having a first-side-surface on the second-direction-side thereof and a first-fixing-portion provided in the second-direction with respect to the first-side-surface and provided with a first-screw-hole, and the first-fixing-portion includes a first-opening-surface, and a first-inclined-surface provided between the first-side-surface and the first-opening-surface and inclined with respect to a surface perpendicular to the first-direction.

17 Claims, 8 Drawing Sheets

(56) References Cited

U.S. PATENT DOCUMENTS

| | | | | |
|---|---|---|---|---|
| 2014/0240401 | A1* | 8/2014 | Okubo | B41J 2/1433 347/47 |
| 2015/0246537 | A1* | 9/2015 | Miyajima | B41J 29/023 347/54 |

FOREIGN PATENT DOCUMENTS

| | | | |
|---|---|---|---|
| JP | 2008-062534 | | 3/2008 |
| JP | 2011-207181 | A | 10/2011 |
| JP | 2011-218750 | | 11/2011 |
| JP | 2012-011562 | | 1/2012 |
| JP | 2012-061719 | | 3/2012 |
| JP | 2012-121278 | | 6/2012 |
| JP | 2014-162063 | | 9/2014 |
| JP | 2015-160361 | | 9/2015 |

* cited by examiner

LIQUID EJECTING APPARATUS

The present application is based on, and claims priority from JP Application Serial Number 2018-223233, filed Nov. 29, 2018 and JP Application Serial Number 2019-166967, filed Sep. 13, 2019, the disclosures of which are hereby incorporated by reference herein in their entirety.

BACKGROUND

1. Technical Field

The present disclosure relates to a liquid ejecting apparatus.

2. Related Art

In the related art, as disclosed in JP-A-2005-96367, a liquid ejecting head is known in which a flow path unit including a nozzle plate having nozzle openings arranged on a nozzle forming surface, a pressure generating chamber communicating with the nozzle openings and pressurizing liquid by pressure generating means, and a liquid storage chamber for storing liquid supplied to the pressure generating chamber is joined to a case head, and the case head and a head cover that protects the nozzle forming surface are fixed by a plurality of bolts.

In the liquid ejecting head, some of the plurality of bolts are disposed in the sub-scanning direction that intersects the main scanning direction of the liquid ejecting head. In the liquid ejecting apparatus using the liquid ejecting head having such a configuration, in order to prevent the interference with the bolt disposed on the sub-scanning direction, it is necessary to dispose a transport unit in a region other than the region in which the bolt is disposed. That is, it is necessary to dispose the transport unit at a position further away from the nozzle plate. As a result, the distance between the nozzle plate and the transport unit becomes long, and there is a problem that the image quality is deteriorated due to a transport error.

SUMMARY

According to an aspect of the present disclosure, there is provided a liquid ejecting apparatus including a liquid ejecting head that ejects liquid from a plurality of nozzles in a first direction and a transport unit that transports a medium in either a second direction orthogonal to the first direction or a third direction opposite to the second direction, in which the liquid ejecting head includes a nozzle plate provided with the plurality of nozzles, a case head provided in a fourth direction opposite to the first direction with respect to the nozzle plate, a circuit substrate supported on a support surface of the case head on the fourth direction side, a holder provided in the fourth direction with respect to the circuit substrate, and a first screw that fixes the case head and the holder, the case head includes a case main body and a first fixing portion provided in the second direction with respect to a first side surface of the case main body on the second direction side and provided with a first screw hole through which the first screw passes, and the first fixing portion includes a first opening surface in which the first screw hole opens in the first direction, and a first inclined surface provided between the first side surface and the first opening surface and inclined with respect to a surface perpendicular to the first direction.

DESCRIPTION OF EXEMPLARY EMBODIMENTS

First, the configuration of a liquid ejecting apparatus 1 will be explained.

Figure 1:
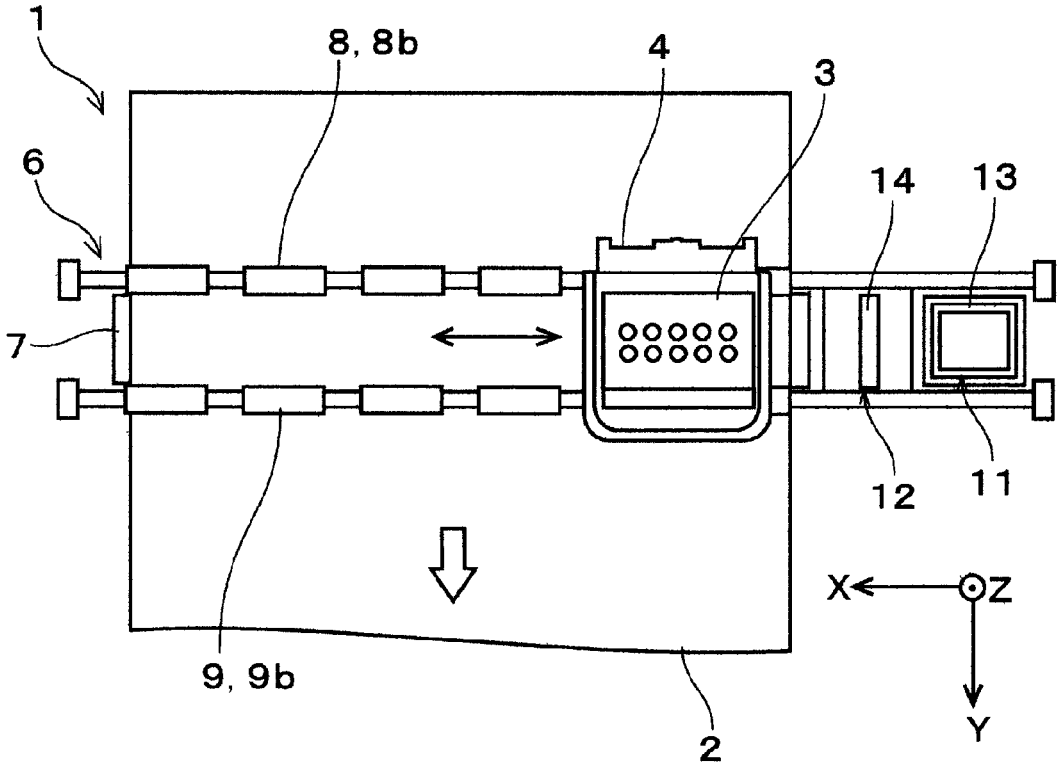
FIG. 1 is a plan view showing a configuration of a liquid ejecting apparatus.
Figure 2:
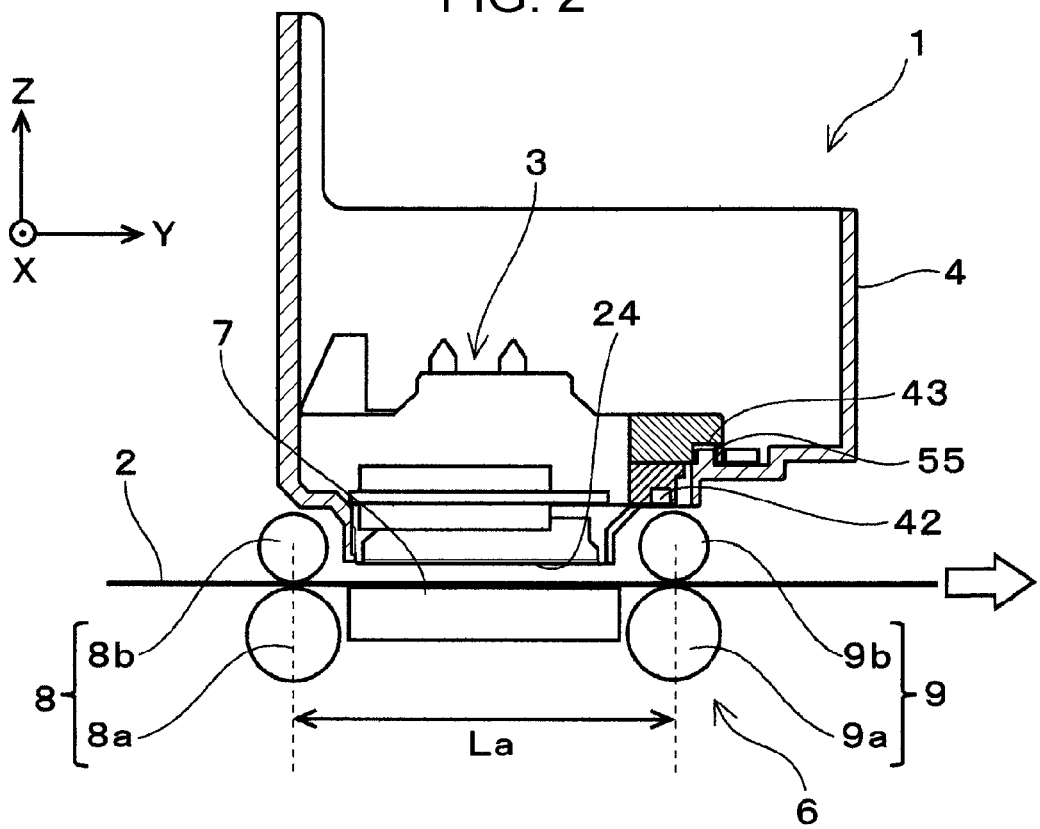
FIG. 2 is a side view showing a configuration around a liquid ejecting head.

FIG. 1 is a plan view showing the configuration of the liquid ejecting apparatus 1, and FIG. 2 is a side view showing the configuration around a liquid ejecting head 3. In FIG. 2, a head holding member 4 and a part of the liquid ejecting head 3 are shown in cross section.

The liquid ejecting apparatus 1 according to the present embodiment is an apparatus that ejects ink as a liquid to a surface of a medium 2 to print or record an image or the like.

The liquid ejecting apparatus 1 includes the liquid ejecting head 3 that ejects ink in a −Z direction as a first direction, the head holding member 4 as a carriage that holds the liquid ejecting head 3, a transport unit 6 capable of transporting the medium 2 in a +Y direction as a second direction or in a −Y direction as a third direction opposite to the second direction, and a head moving mechanism (not shown) that moves the head holding member 4 in a main scanning direction that is the width direction of the medium 2. The transport direction of the medium 2 transported by the transport unit 6 is a sub-scanning direction that intersects the main scanning direction.

The medium 2 is a recording paper such as a sheet or continuous paper, a cloth, or a resin film. The medium 2 is transported onto a platen 7 disposed at a distance from the nozzle plate 24 of the liquid ejecting head 3 by driving the transport unit 6 and is discharged from the liquid ejecting apparatus 1 after ink ejected from each nozzle 29 of the liquid ejecting head 3 is landed and an image is printed.

Hereinafter, among the ±X direction, ±Y direction, and ±Z direction orthogonal to each other, in the present embodiment, the main scanning direction of the liquid ejecting head 3 is defined as the ±X direction, the sub-scanning direction that is the transport direction of the medium 2 is defined as the +Y direction, a plane parallel to the nozzle forming surface of a nozzle plate 24 of the liquid ejecting head 3 is defined as the XY plane, and a direction perpendicular to the nozzle forming surface, that is, the XY plane is defined as ±Z direction. An axis along the ±X direction is defined as an X axis, an axis along the ±Y direction is defined as a Y axis, and an axis along the ±Z direction is defined as a Z axis.

The transport unit 6 includes a first roller pair 8 located upstream in the transport direction from the nozzle forming surface of the liquid ejecting head 3 mounted on the head holding member 4 and a second roller pair 9 located downstream in the transport direction from the nozzle forming surface.

The first roller pair 8 includes a driving roller 8*a* and a driven roller 8*b* that is driven by the driving roller 8*a*, and is configured to be rotatable in directions opposite to each other while the medium 2 is pinched between the driving roller 8*a* and the driven roller 8*b*. The driving roller 8*a* is driven by power from a paper feed motor (not shown). The medium 2 is transported between the nozzle forming surface of the liquid ejecting head 3 and the platen 7 by rotating the driving roller 8*a* and the driven roller 8*b* in directions opposite to each other while the medium 2 is pinched therebetween.

The second roller pair 9 is composed of a driving roller 9*a* and a driven roller 9*b* driven by the driving roller 9*a*. The second roller pair 9 rotates in directions opposite to each other with the medium 2 after printing is pinched therebetween and guides the medium 2 to the paper discharge side.

Here, the transport unit 6 includes a plurality of roller pairs (not shown) other than the first roller pair 8 and the second roller pair 9 described above. However, the first roller pair 8 is a roller pair disposed upstream of the nozzle forming surface and located closest to the nozzle forming surface among the roller pairs included in the transport unit 6, and the second roller pair 9 is a roller pair on the downstream of the nozzle forming surface and is disposed at a position closest to the nozzle forming surface. The rollers 8*b* and 9*b* exemplified as the driven roller pair in the present embodiment may be driving rollers that are driven by power similarly to the rollers 8*a* and 9*a*. That is, it is possible to employ a configuration in which the rollers 8*a* and 8*b* constituting the first roller pair 8 are rotationally driven in directions opposite to each other. Similarly, it is possible to employ a configuration in which the rollers 9*a* and 9*b* constituting the second roller pair 9 are rotationally driven in directions opposite to each other. In the present embodiment, a configuration in which the rollers 8*a* and 9*a* disposed on the opposite side of the recording surface of the medium 2 are driving rollers and the rollers 8*b* and 9*b* disposed on the recording surface of the medium 2 are driven rollers is illustrated. However, the present disclosure is not limited thereto, and the rollers 8*b* and 9*b* disposed on the upper side in the +Z direction may be driving rollers, and the rollers 8*a* and 9*a* disposed on the lower side in the −Z direction may be driven rollers.

As the ink, various inks such as water-based ink and solvent-based ink can be used. The ink is stored in an ink cartridge (not shown) as a liquid storage member. The ink cartridge is detachably attached to the head holding member 4. In addition, a configuration may be employed in which the liquid storage member is disposed on the main body side of the liquid ejecting apparatus 1 and is supplied from the liquid storage member to the liquid ejecting head 3 through a supply tube (not shown). As the liquid storage member, a tank-like member that can be refilled with ink can also be employed. In such a configuration, the head holding member 4 is provided with a member called a sub tank that can adjust the ink supply pressure.

A home position that is a standby position of the liquid ejecting head 3 is set on one end side in the −X direction with respect to the platen 7. In the home position, a capping mechanism 11 and a wiping mechanism 12 are provided in order from one end side to the other end side in the +X direction. The capping mechanism 11 has a cap 13 made of an elastic member such as an elastomer, for example, and is configured to be convertible into a sealed state (capping) in which the cap 13 is brought into contact with the nozzle forming surface of the liquid ejecting head 3 or a retracted state separated from the nozzle forming surface. By suctioning the space in the cap 13 with a negative pressure mechanism such as a suction pump (not shown) with the nozzle forming surface capped, a cleaning operation, which is a type of maintenance to discharge thickened ink, bubbles, and the like together with ink from the nozzles 29 of the liquid ejecting head 3 into the cap 13, is performed.

The wiping mechanism 12 performs a wiping operation as a kind of maintenance for wiping the nozzle forming surface of the liquid ejecting head 3 with a wiper 14. The wiping mechanism 12 in the present embodiment is configured to be convertible into a state in which the wiper 14 is in contact with the nozzle forming surface or a retracted state separated from the nozzle forming surface. The wiper 14 may be of various configurations, for example, made of a blade main body having elasticity with the surface covered with a cloth. In the present embodiment, the liquid ejecting head 3 moves in the main scanning direction while the wiper 14 is in contact with the nozzle forming surface, so that the wiper 14 slides on the nozzle forming surface and wipes (wiping). It is also possible to employ a configuration in which the nozzle forming surface is wiped by the self-running wiper 14 with the liquid ejecting head 3 stopped moving.

Figure 3:
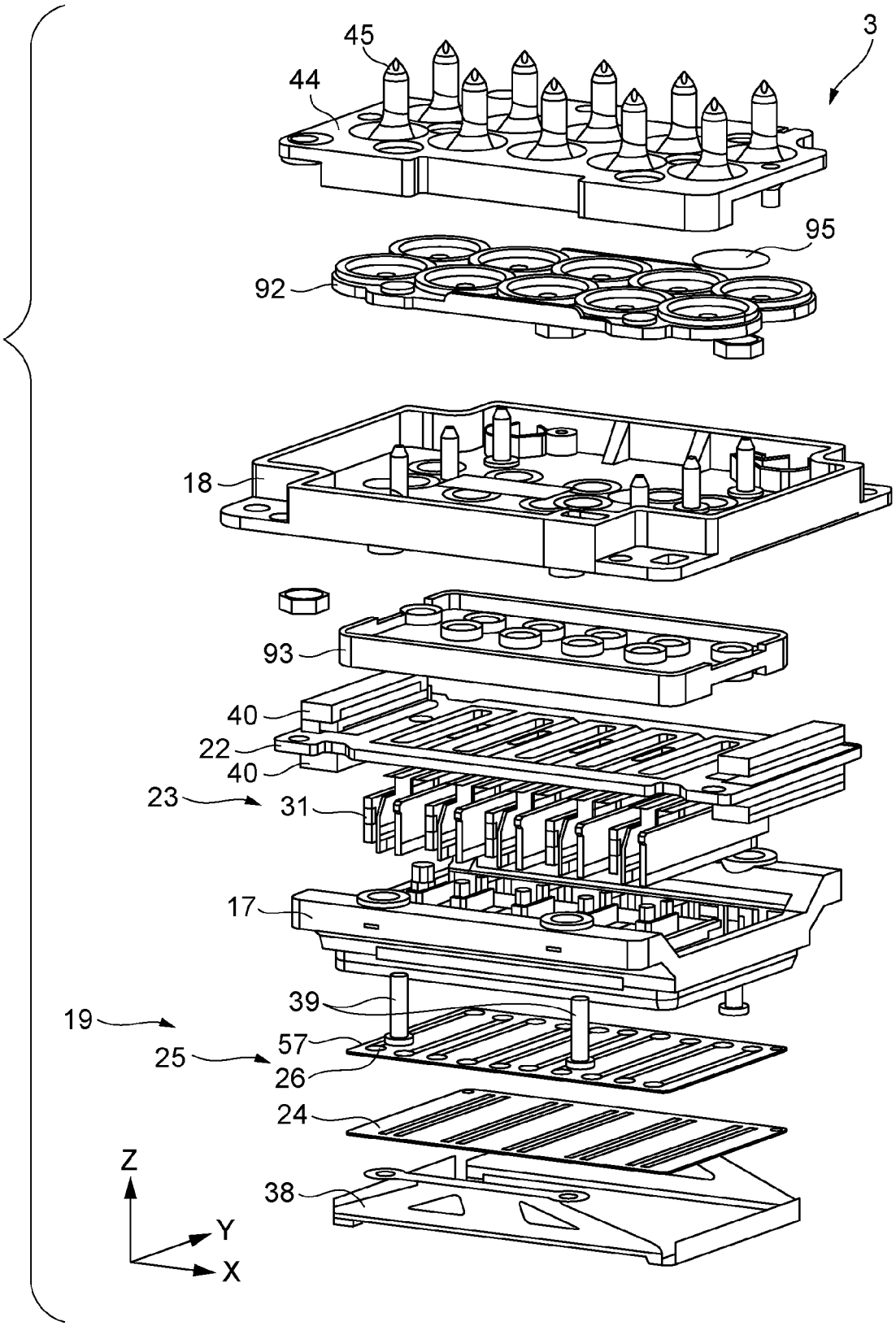
FIG. 3 is an exploded perspective view showing the configuration of the liquid ejecting head.
Figure 4:
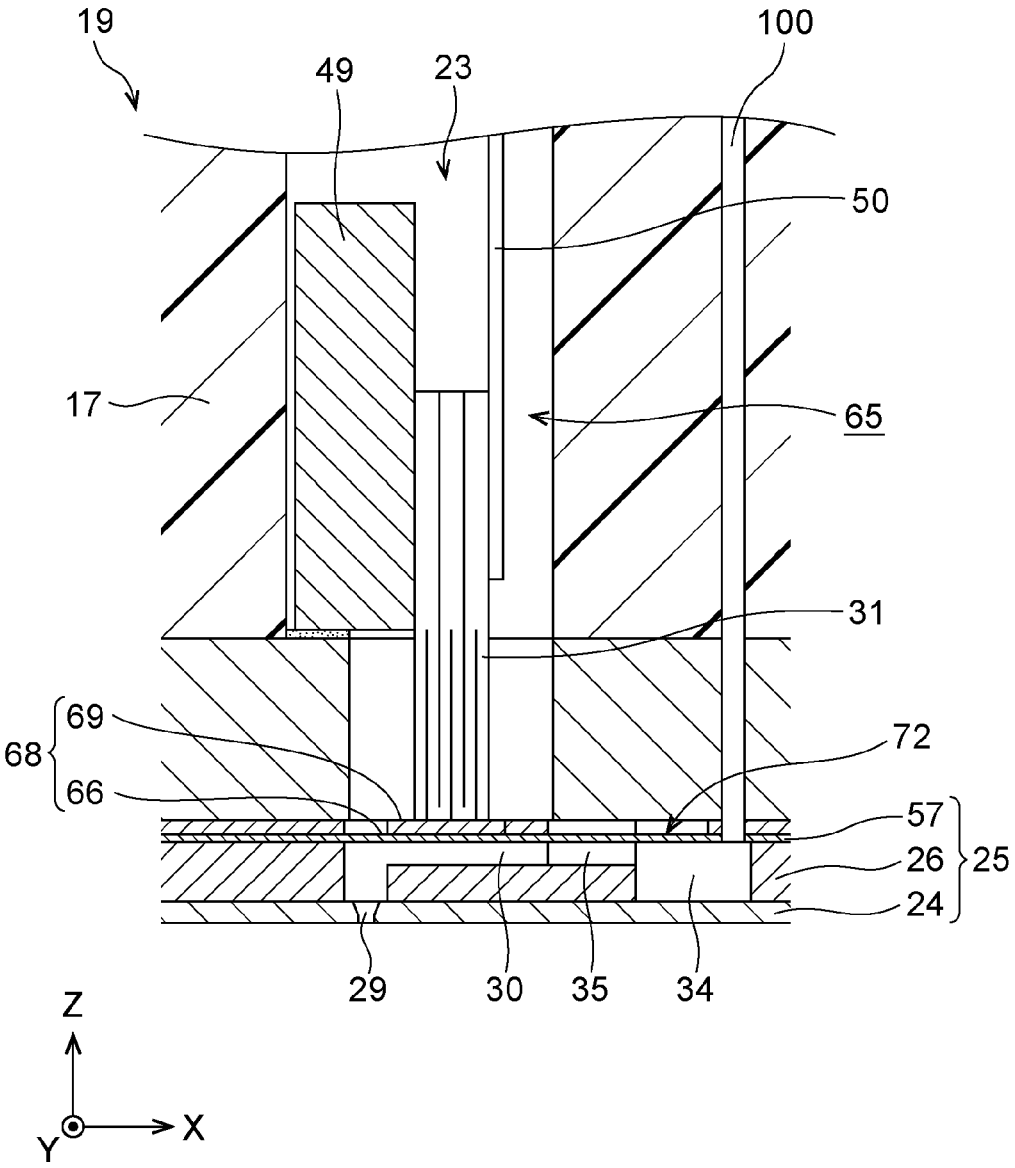
FIG. 4 is a sectional view showing a configuration of a liquid ejecting unit.

FIG. 3 is an exploded perspective view showing the configuration of the liquid ejecting head 3, and FIG. 4 is a sectional view showing a configuration of a liquid ejecting unit 19.

Figure 5:
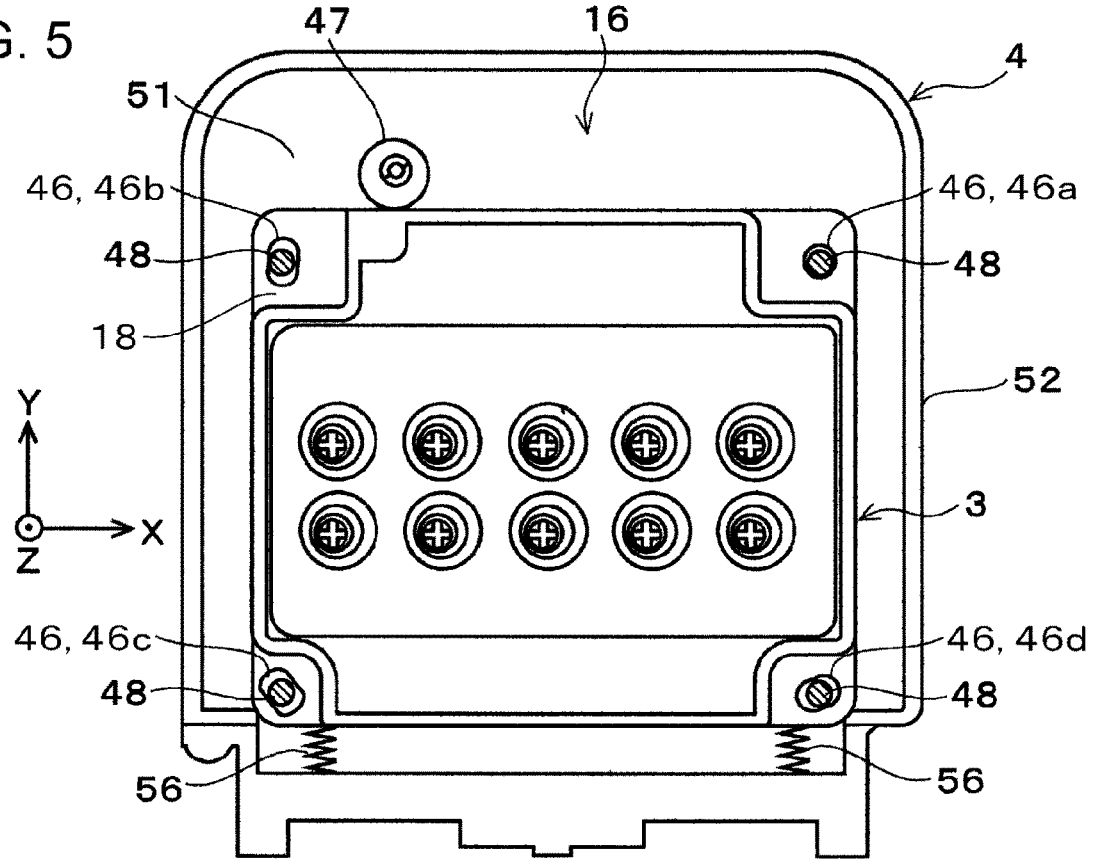
FIG. 5 is a top view showing a configuration of a head holding member.
Figure 6:
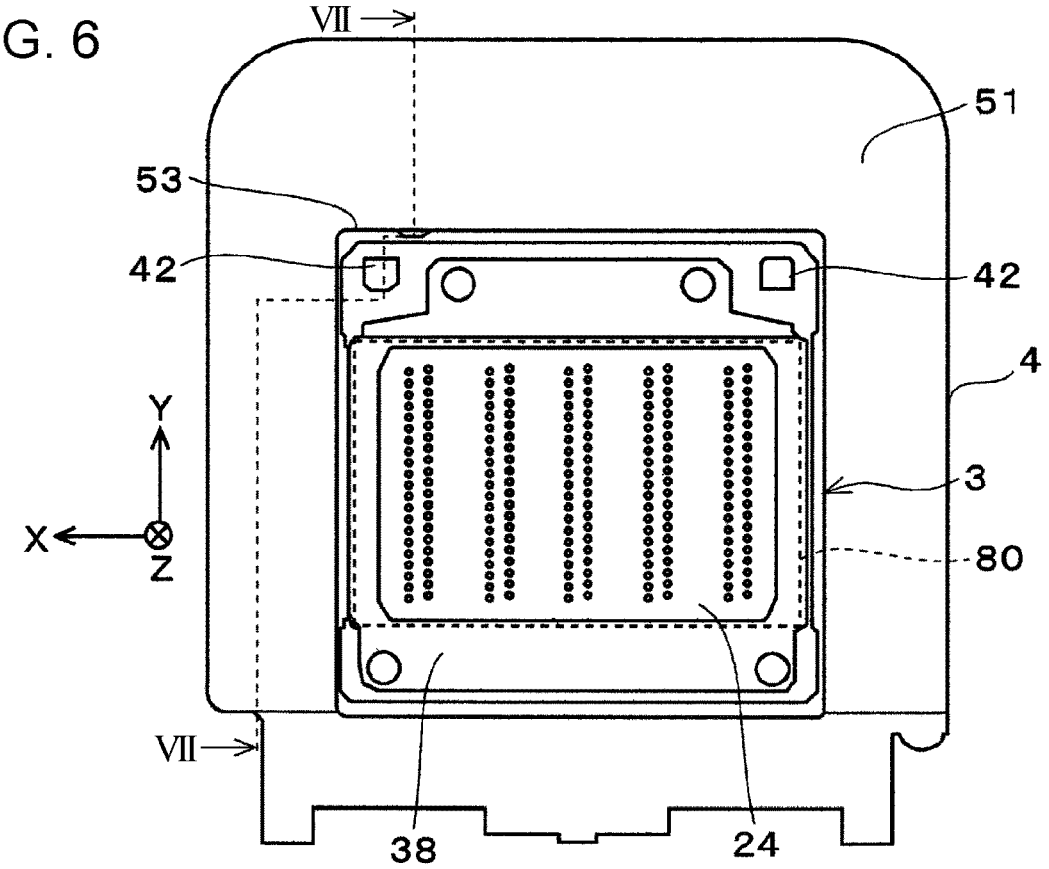
FIG. 6 is a bottom view showing the configuration of the head holding member.
Figure 7:
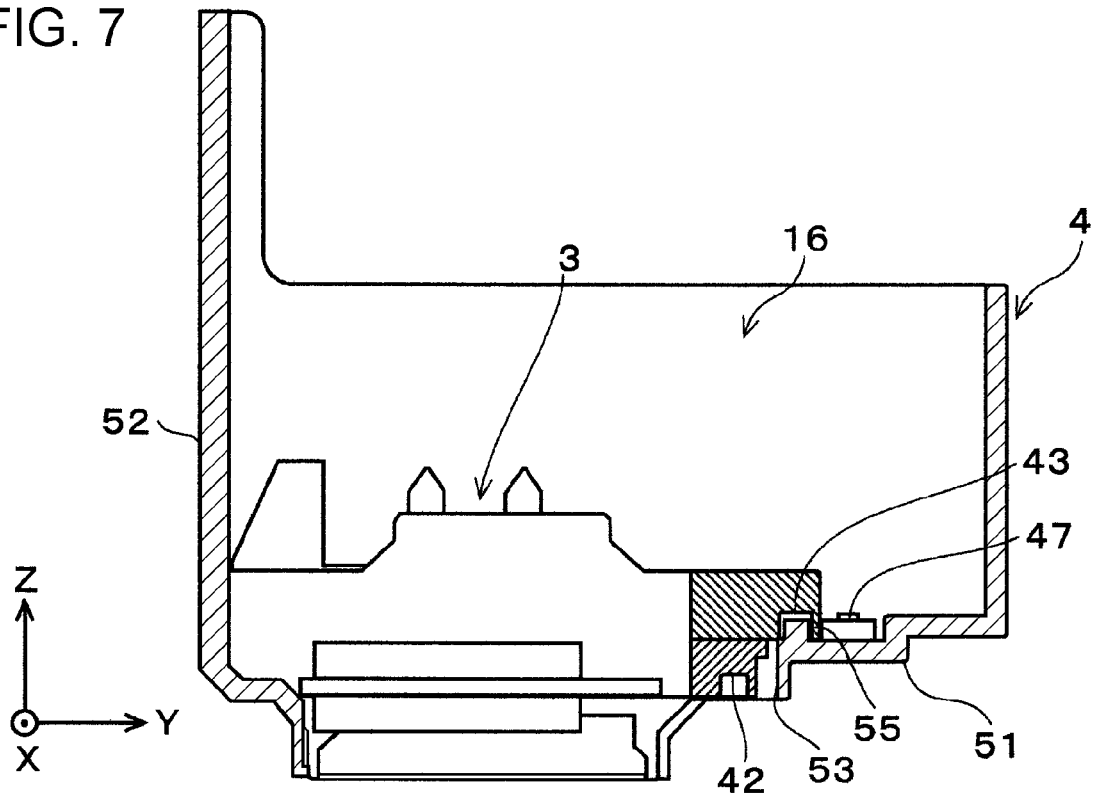
FIG. 7 is a cross-sectional view taken along line VII-VII in FIG. 6.
Figure 8:
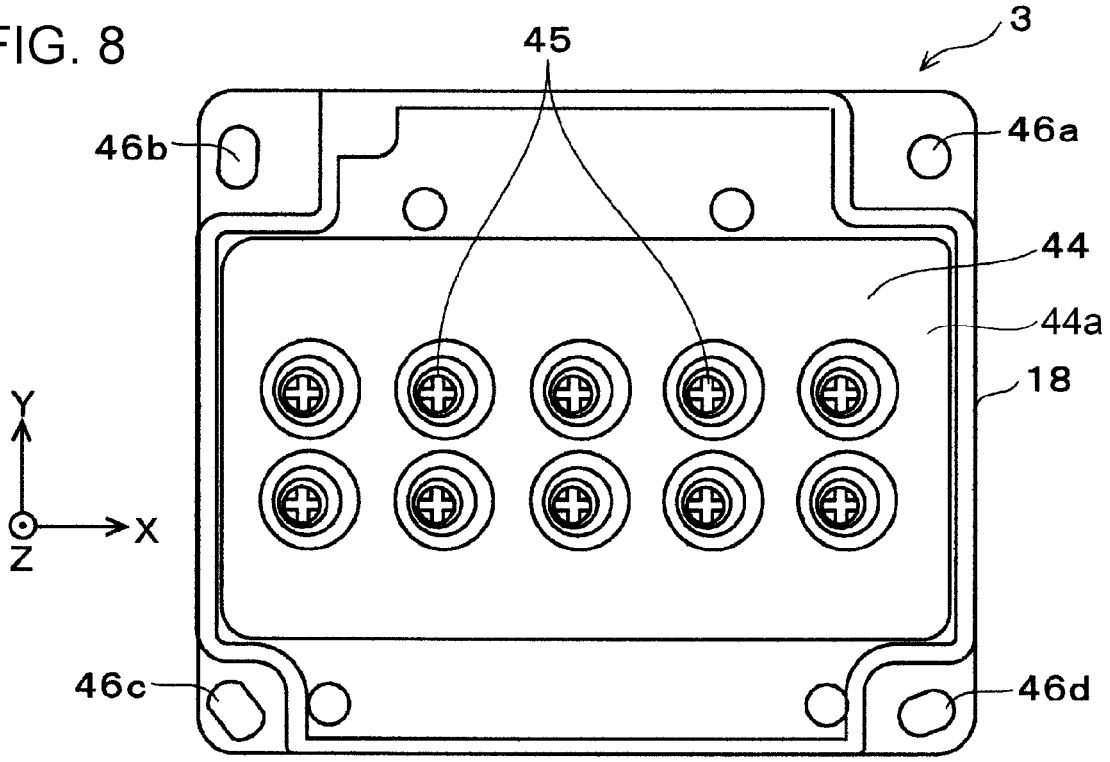
FIG. 8 is a top view showing the configuration of the liquid ejecting head.
Figure 9:
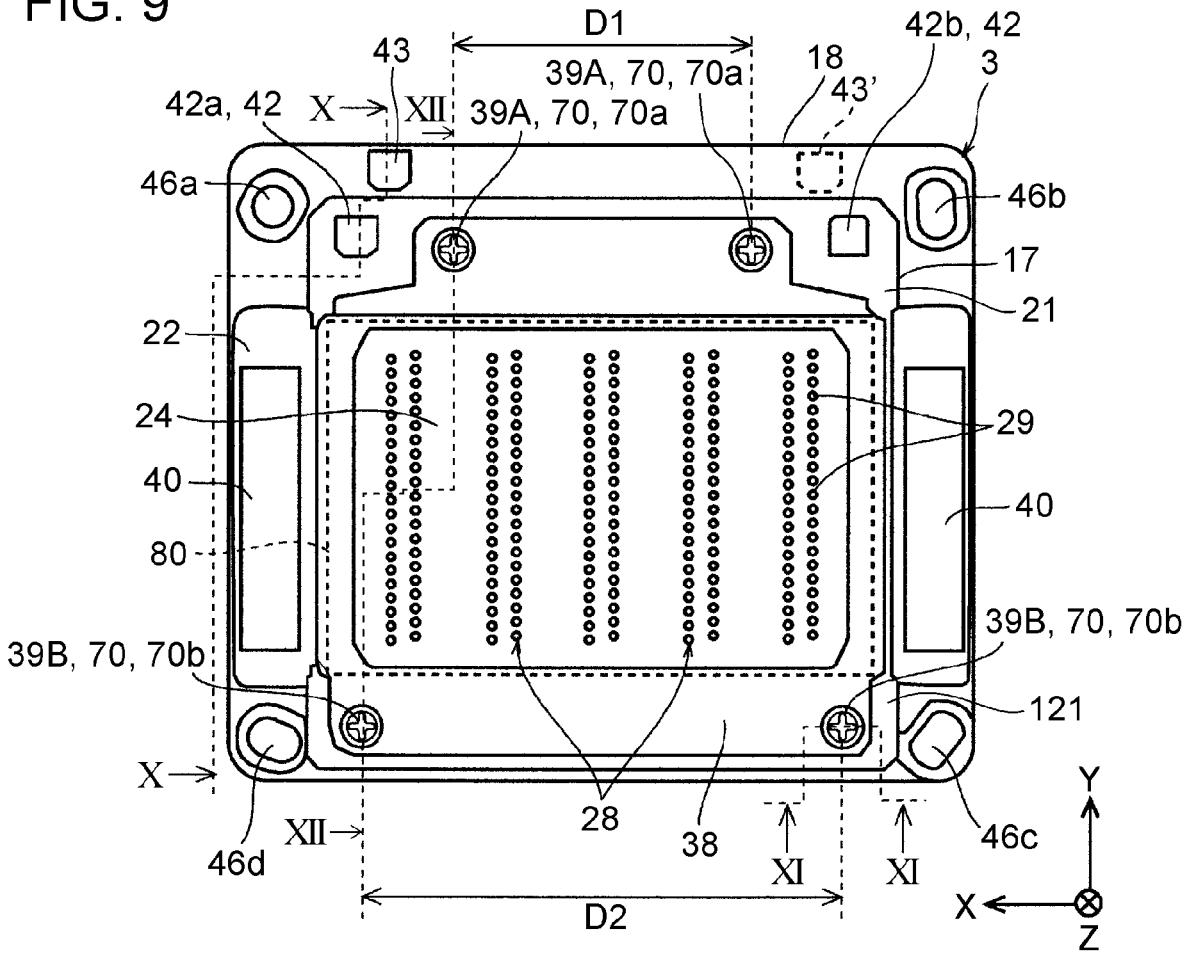
FIG. 9 is a bottom view of the configuration of the liquid ejecting head.
Figure 10:
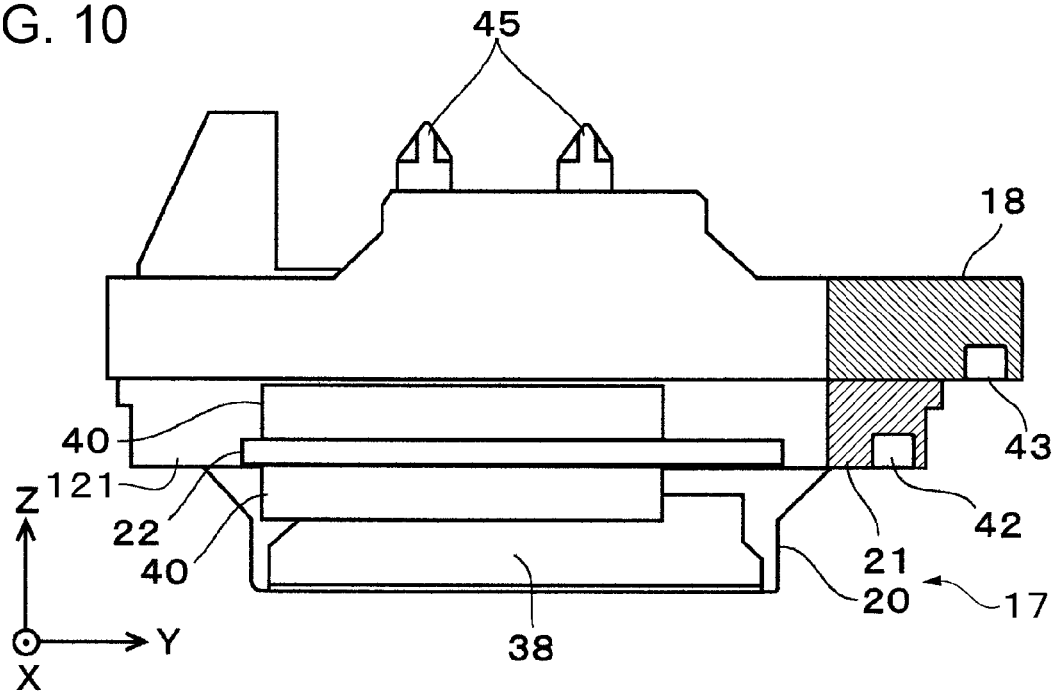
FIG. 10 is a cross-sectional view taken along line X-X in FIG. 9.
Figure 11:
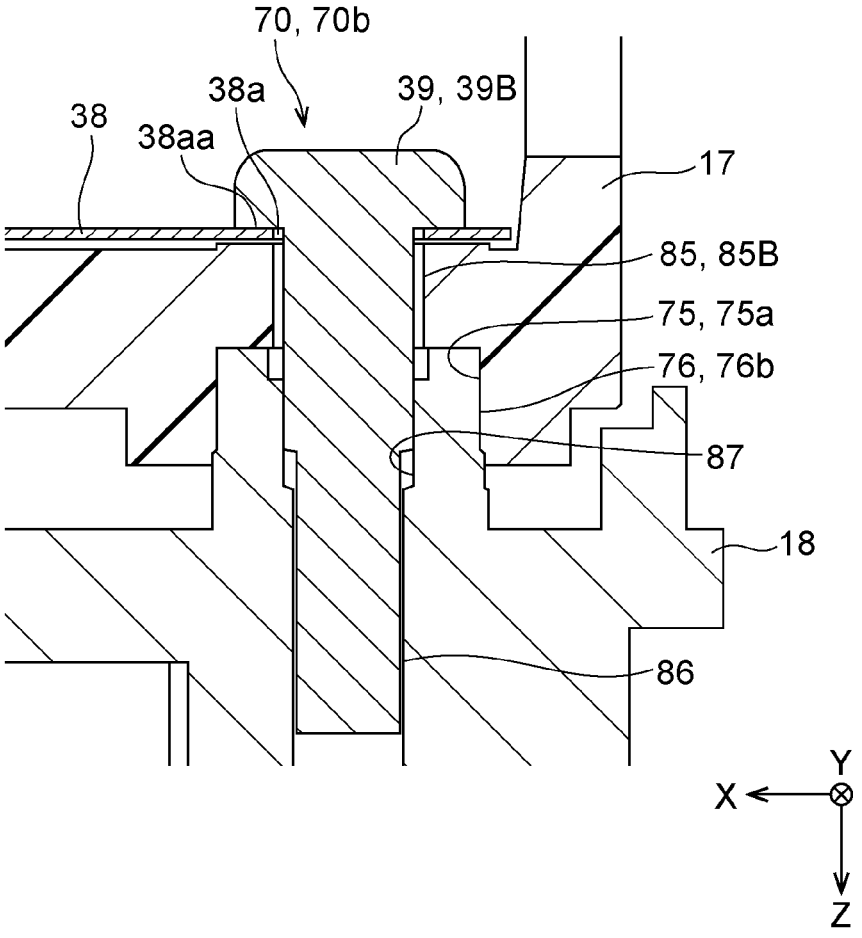
FIG. 11 is a cross-sectional view taken along line XI-XI in FIG. 9.

FIGS. 5 to 7 are views showing a configuration of the head holding member 4 in a state where the liquid ejecting head 3 is attached; FIG. 5 is a top view, FIG. 6 is a bottom view, and FIG. 7 is a cross-sectional view taken along line VII-VII in FIG. 6. FIGS. 8 to 11 are views showing the configuration of the liquid ejecting head 3; FIG. 8 is a top view, FIG. 9 is a bottom view, FIG. 10 is a cross-sectional view taken along line X-X in FIG. 9, and FIG. 11 is a cross-sectional view taken along line XI-XI in FIG. 9.

As shown in FIG. 3, the liquid ejecting head 3 includes a flow path unit 25 including nozzle plate 24, a case head 17 provided in the +Z direction as a fourth direction of the flow path unit 25, a circuit substrate 22 supported by the case head 17, an introduction path unit 18 as a holder provided in the +Z direction of the circuit substrate 22, and a screw 39 as a fixing member for fixing the case head 17 and the introduction path unit 18.

A flow path plate 92 is disposed in the +Z direction of the introduction path unit 18. An attachment member 44 to which a liquid storage member is attached via a filter 95 is disposed on the flow path plate 92. The attachment member 44 is provided with an introduction needle 45.

A seal member 93 is disposed between the introduction path unit 18 and the circuit substrate 22. The circuit substrate 22 includes a wiring circuit for driving ink ejection and a coupler 40 for coupling with a control unit.

The liquid ejecting head 3 includes a vibrator unit 23 including a piezoelectric element 31. The vibrator unit 23 is attached to the case head 17. The liquid ejecting unit 19 including the flow path unit 25 is disposed at the −Z direction end of the case head 17. A lid member 38 is a protective member obtained by press-molding a metal plate, and covers the end surface of the nozzle forming surface of the nozzle plate 24. The lid member 38 is fixed to the case head 17.

As shown in FIG. 4, the liquid ejecting unit 19 includes the case head 17 and the flow path unit 25 stacked on the lower surface side of the liquid ejecting unit 19 in the −Z direction.

As shown in FIG. 10, the case head 17 includes a box-shaped case main body 20 to which the flow path unit 25 is fixed, and a first fixing portion 21 and a second fixing portion 121 having flange portions bonded to the introduction path unit 18. The case head 17 is molded from, for example, synthetic resin, so that the case main body 20, the first fixing portion 21, and the second fixing portion 121 are integrally formed. Inside the case head 17, a flow path 100 for supplying ink from the introduction path unit 18 to the flow path unit 25 is formed. The case head 17 is provided with a flow path pipe 91 that defines a part of the flow path 100. The circuit substrate 22 is laminated on the upper surface side of the case head 17 in the +Z direction.

As shown in FIG. 4, the case head 17 is formed with a storage space 65 for storing the vibrator unit 23 in a state of penetrating in the ±Z directions. The flow path pipe 91 is formed at a position on the outer side with respect to the storage space 65 so as to penetrate in the ±Z direction. The upstream end of the flow path pipe 91 on the +Z direction side opens on the upper surface of the case head 17 and communicates with an intermediate flow path (not shown) formed in the flow path plate 92 (see FIG. 12) disposed in the introduction path unit 18.

The downstream end of the flow path pipe 91 on the −Z direction side opens to the lower surface of the case head 17 and communicates with a common liquid chamber 34 in the flow path unit 25.

The vibrator unit 23 includes the piezoelectric element 31 that functions as a kind of actuator, a fixing plate 49 to which the piezoelectric element 31 is joined, and a first wiring member 50 for applying a drive signal or the like to the piezoelectric element 31. The piezoelectric element 31 is a laminated type piezoelectric element manufactured by cutting a piezoelectric plate in which piezoelectric layers and electrode layers are alternately laminated into comb teeth, and is a longitudinal vibration mode piezoelectric element that can expand and contract (electric field lateral effect type) in a direction orthogonal to the laminating direction (electric field direction). A drive signal is applied to the piezoelectric element 31 from the circuit substrate 22 through the first wiring member 50. As the first wiring member 50, for example, a chip on film (COF) substrate or the like can be employed.

The flow path unit 25 has a flow path substrate 26, and is configured such that the nozzle plate 24 is joined to the surface of the flow path substrate 26 on the −Z direction side, and a vibrating plate 57 is joined to the surface of the flow path substrate 26 on the +Z direction side. The flow path unit 25 is provided with the common liquid chamber 34, an ink supply port 35, a pressure chamber 30, and the nozzle 29. A series of ink flow paths from the ink supply port 35 to the nozzle 29 through the pressure chamber 30 is formed corresponding to each nozzle 29.

The nozzle plate 24 is a plate material in which a plurality of the nozzles 29 is formed at a pitch (for example, 180 dpi) corresponding to the dot formation density. As a material of the nozzle plate 24, a metal plate such as stainless steel, a silicon single crystal substrate, or the like can be employed.

As shown in FIG. 9, in the nozzle plate 24 in the present embodiment, a total of 10 nozzle rows 28 in which the plurality of nozzles 29 is arranged along the Y axis are aligned in a direction along the X axis. In the present embodiment, each nozzle row 28 is configured to be aligned in a direction along the Y axis that is the transport direction of the medium 2. Adjustment of the inclination of the nozzle row 28 with respect to the Y axis will be described later.

The vibrating plate 57 has a double structure in which an elastic film is laminated on the surface of a support plate. In the present embodiment, the vibrating plate 57 is composed of a composite plate material in which a metal plate such as stainless steel is used as a support plate and a resin film is laminated as an elastic film on the surface of the support plate. The vibrating plate 57 is provided with a diaphragm 68 that changes the volume of the pressure chamber 30. The diaphragm 68 is manufactured by partially removing the support plate by etching or the like. That is, the diaphragm 68 includes an island portion 69 to which the tip end surface of the free end of the piezoelectric element 31 is joined, and a flexible portion 66 provided around the island portion 69. The tip end surface of the piezoelectric element 31 is joined to the island portion 69. By expanding and contracting the free end of the piezoelectric element 31, the diaphragm 68 can be displaced and the volume of the pressure chamber 30 can be varied.

In the vibrating plate 57, a compliance portion 72 that seals the common liquid chamber 34 is provided in a portion corresponding to the common liquid chamber 34 of the flow path substrate 26. The compliance portion 72 is formed by removing a support plate in a region facing the opening surface of the common liquid chamber 34 by etching or the like so that the portion is made only of an elastic film. The compliance portion 72 functions as a damper that absorbs pressure fluctuations of the liquid stored in the common liquid chamber 34.

The flow path substrate 26 is a plate-like member that partitions the ink flow path. The flow path substrate 26 is formed, for example, by subjecting a silicon wafer, which is a kind of crystalline base material, to anisotropic etching.

The ink sent from the introduction path unit 18 side is introduced from the flow path pipe 91 into the common liquid chamber 34 and is supplied from the common liquid chamber 34 to the pressure chambers 30 through the ink supply port 35. When the piezoelectric element 31 is driven, a pressure fluctuation occurs in the ink in the pressure chamber 30, and the ink is ejected from a predetermined nozzle 29 due to the pressure fluctuation.

On the lower surface of the case main body 20, as shown in FIG. 9, an opening for exposing the plurality of nozzles 29 is provided, and the lid member 38 that covers the nozzle plate 24 from the −Z direction is attached. The lid member 38 is made of, for example, a thin metal plate member and has a function of protecting the liquid ejecting unit 19 and grounding the nozzle plate 24 by being coupled to a ground line (not shown). The lower surface of the lid member 38 in the −Z direction, that is, the surface facing the medium 2 in the printing operation, and the exposed portion of the nozzle plate 24 on the lower surface correspond to the nozzle forming surface of the liquid ejecting head 3. The lid member 38 is formed with an insertion hole **38*a*, and is fixed to each flange portion of the first fixing portion 21 and the second fixing portion 121 of the case head 17 by a first screw 39A and a second screw 39B through the insertion hole 38*a*. A portion of the lid member 38 that is fixed to the case head 17 by the first screw 39A and the second screw 39B, that is, a portion in which the insertion hole 38*a* is formed is referred to as a fixed portion 70. In the present embodiment, a pair of first screws 39A and second screws 39B are provided, respectively. That is, a total of four insertion holes 38***a* in the lid member 38 are provided corresponding to the pair of first screws 39A and the pair of second screws 39B. Similarly, a total of four screw holes 85 of the case head 17 described later are provided corresponding to each of the pair of first screws 39A and the pair of second screws 39B. Similarly, a total of four female screw portions 86 and communication holes 87 of the introduction path unit 18 to be described later are provided corresponding to each of the pair of first screws 39A and the pair of second screws 39B.

As shown in FIG. 9, the distance in the direction along the X axis between the fixed portions 70 arranged in parallel in the direction along the X axis, that is, the center-to-center distance differs between the upstream and the downstream in the +Y direction that is the transport direction. Specifically, in the +Y direction, the distance D1 in the X direction between fixed portions 70*a* on the side where the first positioning portion 42 described later is provided is shorter than the distance D2 in the +Y direction on the side where the first positioning portion 42 is not formed, that is, in the direction along the X axis between the fixed portions 70*b* on the opposite side across the nozzle plate 24. The fixed portion 70*a* is disposed in a region between the first positioning portion 42*a* and the first positioning portion 42*b* in plan view. That is, when viewed in the +X direction, the first positioning portions 42*a* and 42*b* and the fixed portion 70*a* overlap at least partially. As described above, since the first positioning portion 42 and the fixed portion 70*a* are not overlapped in the +X direction, and are disposed at positions overlapping in the +Y direction, the size of the liquid ejecting head 3 in the +Y direction can be further reduced.

As shown in FIG. 11, a concave portion 75 having an inner peripheral surface 75*a* is provided at a position corresponding to the fixed portion 70*b* of the case head 17. A screw hole 85 (second screw hole 85B) is opened on the negative side of the concave portion 75 in the Z direction, that is, on the upper ceiling surface. The inner diameter of the concave portion 75 is set larger than the inner diameter of the screw hole 85, that is, the opening diameter. A cylindrical convex portion 76 protruding toward the case head 17 is provided at a position corresponding to the fixed portion 70*b* of the introduction path unit 18, that is, at the opening peripheral edge of the female screw portion 86. The communication hole 87 that communicates with the female screw portion 86 is formed inside the convex portion 76. The inner diameter of the communication hole 87 is set slightly larger than the inner diameter of the female screw portion 86, and a screw 39 (second screw 39B) as a fixing member is inserted into the communication hole 87. The outer diameter of the convex portion 76 is set to be the same as or slightly smaller than the inner diameter of the concave portion 75. In FIG. 11, the configuration of one fixed portion 70*b* between the fixed portions 70*b* arranged in the +X direction is illustrated, but the other fixed portion 70*b* has the same configuration. The case head 17 and the introduction path unit 18 are positioned by inserting the convex portion 76 into the concave portion 75 and fitting an outer peripheral surface 76*b* of the convex portion 76 with the inner peripheral surface 75*a* of the concave portion 75. As described above, since the distance D2 between the fixed portions 70*b* in the direction along the X axis is longer than the distance D1 between the fixed portions 70*a* in the direction along the X axis, the positioning accuracy between the case head 17 and the introduction path unit 18 can be increased.

Also at the position corresponding to the fixed portion 70*a* of the case head 17, the screw hole 85 (first screw hole 85A) and the screw 39 (first screw 39A) are disposed in the same manner as described above.

The circuit substrate 22 provided in the case head 17 is a relay substrate for receiving a drive signal from a control unit (not shown) and applying the drive signal to the piezoelectric element 31 through the first wiring member 50. The circuit substrate 22 protrudes in both the +X direction and the −X direction with respect to the case head 17, and the couplers 40 for coupling with the control unit are provided on both the +Z direction side surface and the −Z direction side surface of the circuit substrate 22 in the two protruding portions. That is, a total of four couplers 40 are disposed on both outer sides in the direction along the X axis of the case head 17. A second wiring member (not shown) is coupled to the coupler 40, and a drive signal is received from the control unit side via the second wiring member. As the second wiring member, for example, a flexible flat cable (FFC) or a flat cable can be employed.

In plan view from the +Z direction, each fixed portion 70 is disposed at a position distant from the upstream or the downstream in the direction along the Y axis from an outer periphery 80 of the nozzle plate 24 shown by the broken line in FIGS. 6 and 9. On the other hand, each fixed portion 70 is located on the inner side in the direction along the X axis from the outer periphery 80. Therefore, the coupler 40 can be disposed without interfering with the fixed portion 70 at a position distant from the −X direction side and the +X direction side in the direction along the X axis from the outer periphery 80 of the nozzle plate 24. For this reason, the size of the liquid ejecting head 3 in the direction along the X axis can be made smaller than when the fixed portion 70 is disposed outside the outer periphery 80 of the nozzle plate 24 in the direction along the X axis.

On the lower surface of the flange portion of the first fixing portion 21, the first positioning portion 42 used for positioning the liquid ejecting head 3 is provided on one side in the +Y direction, that is, at the downstream edge in the transport direction. Specifically, the first positioning portions 42 (42*a* and 42*b*) are formed at both downstream corners on the lower surface of the flange portion of the first fixing portion 21, respectively. These first positioning portions 42*a* and 42*b* are configured by, for example, a concave portion that is recessed from the lower surface of the flange portion of the first fixing portion 21 to the middle of the flange portion in the thickness direction, that is +Z direction, or a through-hole that penetrates the flange portion. In the present embodiment, these first positioning portions 42*a* and 42*b* are not used, but are used for positioning with other head holding members.

The introduction path unit 18 includes the flow path plate 92 in which an intermediate flow path for introducing the ink supplied from the liquid storage member side to the flow path pipe 91 side is formed. As shown in FIG. 9, the introduction path unit 18 is formed larger than the flange portion of the case head 17 in plan view, and is stacked on the upper surface of the flange portion. As shown in FIG. 8, the attachment member 44 on the introduction path unit 18 is partitioned with an attachment region 44*a* of the liquid storage member. In the attachment region 44*a*, an upstream opening portion of the ink introduction path is provided so as to open in the +Z direction, and a plurality of introduction needles 45 is attached to the opening portion via the filter 95. In the present embodiment, two rows of five introduction needles 45 arranged side by side along the X axis are formed along the Y axis, and a total of 10 introduction needles 45 are erected. When these introduction needles 45 are inserted into the liquid storage member attached to the attachment region 44*a*, the ink stored in the liquid storage member is introduced to the flow path pipe 91 side through the intermediate flow path of the flow path plate 92. Each introduction needle 45 has a hollow needle shape and has an introduction hole at the tip end. The base side of the introduction needle 45 has a hem-expanding shape that increases in diameter toward the downstream opening. The configuration in which the introduction path unit 18 introduces ink is not limited to the configuration using such a needle-shaped introduction needle 45. For example, it is also possible to adopt a so-called foam type configuration in which a porous material such as a nonwoven fabric or sponge is disposed in the ink introduction portion of the introduction path unit 18, a porous material is also provided in the ink outlet portion of the liquid storage member correspondingly, and both porous members are brought into contact with each other to exchange liquid by capillary phenomenon.

As shown in FIG. 5, at the four corners of the introduction path unit 18, each screw hole 46 through which a male screw portion of a fixing member 48 such as a screw or a bolt (not shown) used for fixing to the head holding member 4 is inserted is formed through the thickness direction of the introduction path unit 18, that is, the direction along the Z axis. In FIG. 5, only the male screw portion of the fixing member 48 is shown in cross section. Among these screw holes 46, one screw hole 46*a* of the two screw holes 46 located on the downstream in the +Y direction of the introduction path unit 18 is a circular through-hole that is slightly larger than the outer diameter of the male screw portion of the fixing member 48, and is configured to have a slight gap between the male screw portion and the screw hole 46*a*. The screw hole 46*a* is disposed at a position closest to a second positioning portion 43 as a positioning portion described later. In FIG. 9, each of the screw holes 46*b*, 46*c*, and 46*d* respectively disposed at the corners of the introduction path unit 18 clockwise from the screw holes 46*a* is a long hole having a short diameter set the same length as the diameter of the screw hole 46*a* and having a long diameter set longer than the diameter of the screw hole 46*a*. Each screw hole 46*b*, 46*c*, and 46*d* is formed so that the direction of the long diameter thereof is generally along the circumferential direction of a virtual circle centering on the second positioning portion 43 described later. That is, when fixing the liquid ejecting head 3 to the head holding member 4 by inserting the male screw portion of the fixing member 48 into each screw hole 46, the position of the liquid ejecting head 3 with respect to the head holding member 4 can be finely adjusted in the circumferential direction of the virtual circle with the second positioning portion 43 as the center within the range of the gap formed between each screw hole 46*a* to 46*d* and the male screw portion of the fixing member 48 inserted in each screw hole. The position adjustment of the liquid ejecting head 3 is performed by an adjustment mechanism 47 provided in the head holding member 4. This point will be described later.

As shown in FIG. 9, on the lower surface of the introduction path unit 18, the second positioning portion 43 used for positioning with the head holding member 4 is provided at a portion extending to the downstream in the +Y direction from the flange portion of the first fixing portion 21 of the case head 17 and a position biased toward the screw hole 46*a* in the direction along the X axis direction. The second positioning portion 43 serves as a rotation center at the time of position adjustment by the adjustment mechanism 47 described later. Regarding the positional relationship between the second positioning portion 43 and the first positioning portion 42, the first positioning portion 42 is disposed at a position closer to the nozzle forming surface than the second positioning portion 43 in the +Y direction that is the transport direction. The first positioning portion 42 is disposed at a position closer to the nozzle forming surface compared to the second positioning portion 43 in the direction along the Z axis, which is a direction orthogonal to the nozzle forming surface. That is, when positioning the liquid ejecting head 3 and the other head holding member, positioning using the first positioning portion 42 located closer to the nozzle forming surface in the direction along the Y axis and the direction along the Z axis can define the position of the nozzle forming surface with higher accuracy. In the present embodiment, it is a configuration for positioning the liquid ejecting head 3 and the head holding member 4 using the second positioning portion 43. However, as described below, the inclination of the nozzle forming surface in the direction along the X axis and the direction along the Y axis can be adjusted with higher accuracy by employing a configuration that adjusts the position of the liquid ejecting head 3 with respect to the head holding member 4 by the adjustment mechanism 47, so that the positional accuracy of the nozzle forming surface, that is, the positional accuracy of each nozzle 29 can be secured.

In the present embodiment, the configuration in which only one second positioning portion 43 is formed is illustrated, but the present disclosure is not limited to this. In addition to the second positioning portion 43 on the screw hole 46*a* side in the direction along the X axis on the lower surface of the introduction path unit 18, it is also possible to employ a configuration in which a second positioning portion 43' (a portion indicated by a broken line in FIG. 9) is provided close to the screw hole 46*b* side in the portion extending in the +Y direction from the flange portion of the first fixing portion 21 of the case head 17.

The head holding member 4 in the present embodiment is a box-like member with an open upper surface that includes a bottom plate 51 and a side wall 52 that stands up from the periphery of the bottom plate 51 and surrounds the four sides of the bottom plate 51. A space partitioned by the bottom plate 51 and the side wall 52 functions as an accommodating space 16 that accommodates the liquid ejecting head 3. The upper surface of the bottom plate 51 that is the surface on the side of the accommodating space 16 functions as a head disposal portion and is a portion on which the liquid ejecting head 3 is mounted. The bottom plate 51 is provided with an insertion port 53 that penetrates in the direction along the Z axis. The insertion port 53 is a through-hole having a size through which the case main body 20 of the liquid ejecting head 3 can be inserted and into which the introduction path unit 18 cannot be inserted. When accommodating and attaching the liquid ejecting head 3 in the accommodating space 16 of the head holding member 4, the case main body 20 is inserted into the insertion port 53 so as to protrude outward from the bottom plate 51 of the head holding member 4, that is, downward. When the lower surface of the introduction path unit 18 of the liquid ejecting head 3 is seated on the bottom plate 51 of the head holding member 4, the position of the liquid ejecting head 3 in the direction along the Z axis in the head holding member 4 is defined.

Although not shown, the bottom plate 51 of the head holding member 4 is formed with a total of four female screw portions corresponding to the screw holes 46*a* to 46*d* on the liquid ejecting head 3 side. When fixing the liquid ejecting head 3 to the head holding member 4, the liquid ejecting head 3 can be screwed to the head holding member 4 by inserting the male screw portion of the fixing member 48 from the screw holes 46*a* to 46*d* side of the liquid ejecting head 3 and screwing it into the female screw portion of the bottom plate 51. On the upper surface of the bottom plate 51, a protrusion 55 protruding upward from the bottom plate 51 in the +Z direction is formed at a position corresponding to the second positioning portion 43 of the liquid ejecting head 3. Positioning of the head holding member 4 and the liquid ejecting head 3 is performed as the case main body 20 of the liquid ejecting head 3 is inserted through the insertion port 53 and the protrusion 55 is inserted into the second positioning portion 43. That is, the position of the nozzle forming surface, more specifically, the position of each nozzle 29 in the direction along the X axis and the direction along the Y axis can be generally defined. The protrusion 55 is disposed at a position farther from the nozzle forming surface than the first positioning portion 42 of the liquid ejecting head 3 held by the head holding member 4 in the direction along the Y axis.

The bottom plate 51 of the head holding member 4 is provided with the adjustment mechanism 47 for adjusting the disposal position of the liquid ejecting head 3. The adjustment mechanism 47 in the present embodiment is composed of, for example, an eccentric cam, and is provided at a position capable of contacting the downstream end surface of the liquid ejecting head 3 in the +Y direction disposed on the bottom plate 51 (for example, the downstream end surface of the introduction path unit 18 in the Y direction) and a position where the second positioning portion 43 and the protrusion 55 are biased to the opposite side across the center of the liquid ejecting head 3 in the +X direction (for example, the position on the screw hole 46*b* side). The upstream end surface of the liquid ejecting head 3 in the +Y direction disposed on the bottom plate 51 is urged toward the adjustment mechanism 47 side, that is, the downstream by an urging member 56 such as a spring. The adjustment mechanism 47 is not limited to the illustrated eccentric cam, and various configurations can be employed as long as the position of the liquid ejecting head 3 can be adjusted. For example, a configuration in which the position of the liquid ejecting head 3 is adjusted by the tightening amount of the adjusting screw in a state in which the tip end is in contact with the liquid ejecting head 3 can also be employed.

When attaching the liquid ejecting head 3 to the head holding member 4 in the manufacturing process of the liquid ejecting apparatus 1, the case main body 20 of the liquid ejecting head 3 is inserted into the insertion port 53 of the head holding member 4, the protrusion 55 of the head holding member 4 is inserted into the second positioning portion 43 of the liquid ejecting head 3, and the lower surface of the introduction path unit 18 is seated on the bottom plate 51 of the head holding member 4 so that the liquid ejecting head 3 is roughly positioned on the head holding member 4. In this state, as described above, the liquid ejecting head 3 is urged toward the adjustment mechanism 47 by the urging member 56. Next, the male screw portion of the fixing member 48 is inserted into each screw hole 46, and the fixing member 48 is screwed into the female screw portion of the head holding member 4 to the extent that the liquid ejecting head 3 can be moved somewhat relative to the head holding member 4 so that the liquid ejecting head 3 is temporarily fixed to the head holding member 4. In this state, the position of the liquid ejecting head 3 is adjusted by the adjustment mechanism 47. In the present embodiment, by rotating the adjustment mechanism 47 that is an eccentric cam, the position of the liquid ejecting head 3 with respect to the head holding member 4, particularly the inclination of the nozzle forming surface with respect to the direction along the X axis and the direction along the Y axis is adjusted. That is, when the adjustment mechanism 47 is rotated, the cam diameter from the rotation center to the outer peripheral surface in contact with the introduction path unit 18 increases or decreases, and as described above, the position of the liquid ejecting head 3 can be finely adjusted with the second positioning portion 43 as the center. In the position adjustment, for example, the position adjustment can be performed using the adjustment mechanism 47 such that ink is ejected from each nozzle 29 to the medium 2 to print a test pattern such as a ruled line, and based on the test pattern, each nozzle row 28 on the nozzle forming surface is parallel to the direction along the Y axis, that is, the ruled lines of the inspection pattern are aligned in the direction along the Y axis. When the position adjustment is completed, the liquid ejecting head 3 is permanently fixed to the head holding member 4 by tightening the fixing member 48.

Even if the liquid ejecting head 3 and the head holding member 4 are positioned using the second positioning portion 43, which has lower positioning accuracy than the first positioning portion 42 in the present embodiment, the position of each nozzle on the nozzle forming surface can be adjusted with higher accuracy by having the adjustment mechanism 47. According to the configuration of the present embodiment, compared to the first positioning portion 42, the positioning is performed using the second positioning portion 43 located farther from the nozzle forming surface in the direction along the Z axis, in other words, further away from the nozzle forming surface. Therefore, as shown in FIG. 2, the positioning with the head holding member 4 is performed by the introduction path unit 18 provided above the case head 17, and the reduction of the space where the driven roller 9*b* of the second roller pair 9 of the transport unit 6 is disposed is suppressed. That is, the space below the portion where the first positioning portion 42 is provided can be used as the disposal space for the driven roller 9*b* of the second roller pair 9. Thereby, the distance (interaxial distance) La between the driven roller 8*b* of the first roller pair 8 and the driven roller 9*b* of the second roller pair 9 can be further shortened. More specifically, the driven roller 9*b* of the second roller pair 9 on the downstream is disposed at a position closer to the nozzle forming surface as compared with the second positioning portion 43 in the direction along the Y axis. As a result, the transport accuracy of the medium 2 is increased, and the landing accuracy of the liquid on the medium 2 can be further improved. In the present embodiment, by having the adjustment mechanism 47, the position of each nozzle on the nozzle forming surface can be adjusted with higher accuracy, so that the landing accuracy of the liquid on the medium 2 can be further improved. For this reason, it contributes to the improvement of the image quality of the image and the like printed and recorded on the medium 2.

The configuration has been described in which the image quality is improved as the driven roller 9*b* of the second roller pair 9 on the downstream can be disposed at a position closer to the nozzle forming surface in the direction along the Y axis by engagement between the second positioning portion 43 of the liquid ejecting head 3 and the protrusion 55 of the head holding member 4. However, in the present embodiment, there are problems peculiar to the liquid ejecting head 3 itself. Specifically, the liquid ejecting head 3 of the present embodiment has a total of 10 nozzle rows 28, and has a relatively large number of nozzle rows 28. For this reason, the circuit substrate 22 needs a denser wiring region corresponding to the large number of nozzle rows 28. For this reason, it is difficult to provide the circuit substrate 22 with screw holes through which the screw 39 for fixing the circuit substrate 22 to the case head 17 is passed. In order to suppress the increase in the width direction of the liquid ejecting heads 3 in which the nozzle rows 28 are arranged along the X axis, it is difficult to provide the fixed portion 70 with the screw 39 outside the circuit substrate 22 along the X axis.

On the other hand, when the fixed portions 70 are provided on both outer sides of the circuit substrate 22 in the transport direction, there is no space for disposing the transport unit 6 below the fixed portion 70. Therefore, in order to avoid interference with the fixed portion 70, the transport unit 6 has to be disposed at a position away from the liquid ejecting head 3 in the horizontal direction. Then, the distance between the first roller pair 8 and the second roller pair 9 becomes long, and the image quality is deteriorated due to the transport error of the medium 2.

A configuration in which a space is secured below the fixed portion 70 by lengthening the case main body 20 of the case head 17 of the liquid ejecting head 3 in the direction along the Z axis and the first roller pair 8 and the second roller pair 9 are disposed in the space to shorten the distance between the first roller pair 8 and the second roller pair 9 is conceivable, but in this case, the liquid ejecting head 3 is enlarged in the direction along the Z axis.

Therefore, even when the fixed portions 70 are provided on both outer sides of the circuit substrate 22 in the transport direction, it is a problem to suppress the enlargement of the liquid ejecting head 3 and to improve the image quality.

Hereinafter, a configuration of the liquid ejecting apparatus 1 for solving the above problem will be described.

Figure 12:
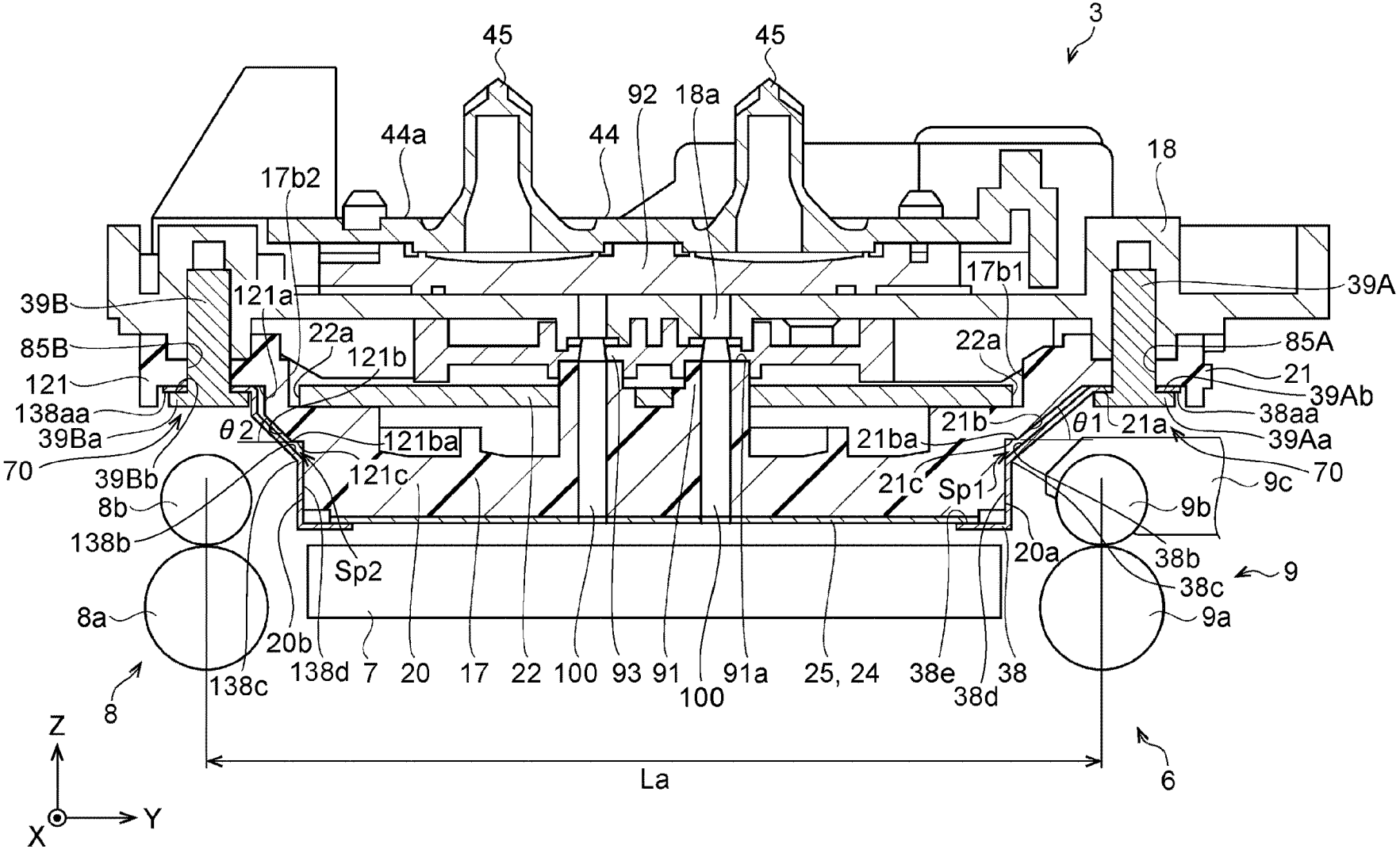
FIG. 12 is a cross-sectional view taken along line XII-XII in FIG. 9 and view showing a disposal position of a transport unit.

FIG. 12 is a cross-sectional view taken along line XII-XII in FIG. 9 and a view showing a disposal position of the transport unit 6.

The liquid ejecting head 3 includes the flow path unit 25 including a nozzle plate 24 provided with a plurality of nozzles 29, the case head 17 provided in the +Z direction as the fourth direction, which is opposite to the −Z direction as the first direction, with respect to the nozzle plate 24, the circuit substrate 22 supported on support surface 17*a* of case head 17 on the +Z direction side, the introduction path unit 18 provided in the +Z direction with respect to the circuit substrate 22, the first screw 39A for fixing the case head 17 and the introduction path unit 18, and the second screw 39B for fixing the case head 17 and the introduction path unit 18.

The case head 17 includes the case main body 20, the first fixing portion 21 which is provided so as to protrude in the +Y direction from the first side surface 20*a* of the case main body 20 on the +Y direction side and on which a first screw hole 85A through which the first screw 39A passes is formed, and the second fixing portion 121 which is provided so as to protrude in the −Y direction from the second side surface 20*b* of the case main body 20 on the −Y direction side and on which the second screw hole 85B formed through which the second screw 39B passes is formed.

The case main body 20 fixes the flow path unit 25 on the surface on the −Z direction side and has a part of the support surface 17*a* that supports the circuit substrate 22 on the surface on the +Z direction side.

The surface of the first fixing portion 21 on the −Z direction side has a first opening surface 21*a* in which the first screw hole 85A opens in the −Z direction, a first inclined surface 21*b* provided between the first side surface 20*a* and the first opening surface 21*a* in the direction along the Y axis and inclined with respect to a surface perpendicular to the −Z direction, and the connection surface 21*c* perpendicular to the −Z direction that connects one end 21*ba* of the first inclined surface 21*b* on the −Y direction side with the first side surface 20*a*. The first opening surface 21*a* is a flat surface facing the bearing surface 39Ab of the screw head 39Aa of the first screw 39A via the lid member 38. The first inclined surface 21*b* is an inclined surface that inclines in the +Z direction from the one end 21*ba* toward the +Y direction. In the present embodiment, the first inclined surface 21*b* is a surface that is continuous with the first opening surface 21*a*.

The surface of the first fixing portion 21 on the +Z direction side has a part of the support surface 17*a* and an inner wall surface 17*b*1 that is continuous with the support surface 17*a* and extends in the +Z direction.

The surface of the second fixing portion 121 on the −Z direction side has a second opening surface 121*a* where the second screw hole 85B opens in the −Z direction, the second inclined surface 121*b* that is provided between the second side surface 20*b* and the second opening surface 121*a* in the direction along the Y axis and is inclined with respect to a surface perpendicular to the −Z direction, and the connection surface 121*c* perpendicular to the −Z direction that connects one end 121*ba* of the second inclined surface 121*b* on the +Y direction side and the second side surface 20*b*. The second opening surface 121*a* is a flat surface facing the bearing surface 39Bb of a screw head 39Ba of the second screw 39B via the lid member 38. The second inclined surface 121*b* is an inclined surface that inclines in the +Z direction from the one end 121*ba* toward the −Y direction.

The surface of the second fixing portion 121 on the +Z direction side includes a part of the support surface 17*a* and an inner wall surface 17*b*2 that is continuous with the support surface 17*a* and extends in the +Z direction.

As can be seen from the above description, the support surface 17*a* in the present embodiment is provided on the case main body 20, the first fixing portion 21, and the second fixing portion 121.

The circuit substrate 22 is interposed between the pair of inner wall surfaces 17*b*1 and 17*b*2 and supported by the support surface 17*a*. The inner wall surface 17*b*1 is disposed in the −Y direction with respect to the first screw 39A, and the inner wall surface 17*b*2 is disposed in the +Y direction with respect to the second screw 39B. That is, the disposing region of the circuit substrate 22 partitioned by the support surface 17*a* and the inner wall surfaces 17*b*1 and 17*b*2 is a position in the −Y direction with respect to the first screw 39A and a position in the +Y direction with respect to the second screw 39B. As a result, the circuit substrate 22 can be disposed without a through-hole or the like for passing the first screw 39A and the second screw 39B. Therefore, a sufficient wiring formation region on the circuit substrate 22 can be secured.

The circuit substrate 22 has a portion disposed in the +Y direction with respect to the first side surface 20*a* and a portion disposed in the −Y direction with respect to the second side surface 20*b*. Specifically, an end surface 22*a* in the +Y direction of the circuit substrate 22 is disposed in the +Y direction with respect to the first side surface 20*a*, and an end surface 22*a* in the −Y direction of the circuit substrate 22 is disposed in the −Y direction with respect to the second side surface 20*b*. That is, the circuit substrate 22 is supported by the support surfaces 17*a* provided on the case main body 20, the first fixing portion 21, and the second fixing portion 121, respectively. Accordingly, the wiring formation region can be increased by increasing the dimension of the circuit substrate 22 in the direction along the Y axis compared to a configuration in which the dimension in the direction along the Y axis of the circuit substrate 22 is smaller than the dimension in the direction along the Y axis of the case main body 20, and the circuit substrate 22 is supported only on the support surface 17*a* provided on the case main body 20.

Here, a difference in configuration between the comparative example and the present embodiment in the case where the first fixing portion 21 is not provided with the first inclined surface 21*b* and the second fixing portion 121 is not provided with the second inclined surface 121*b* will be described. Compared to the configuration of the comparative example in which the connection surface 21*c* extends in the +Y direction instead of the first inclined surface 21*b*, and the connection surface 121*c* extends in the −Y direction instead of the second inclined surface 121*b*, a space is formed in a region facing the first inclined surface 21*b* and a region facing the second inclined surface 121*b* by providing the case head 17 with the first inclined surface 21*b* and the second inclined surface 121*b* in the present embodiment. By providing the first inclined surface 21*b* and the second inclined surface 121*b*, the first opening surface 21*a* can be disposed in the +Z direction with respect to the connection surface 21*c*, and the second opening surface 121*a* can be disposed in the +Z direction with respect to the connection surface 121*c*. That is, compared to the comparative example, a space can be secured on the −Z direction side of the first fixing portion 21 and on the −Z direction side of the second fixing portion 121. Therefore, compared to the configuration of the comparative example, it becomes easier to dispose a part of the transport unit 6, that is, the driven roller 9*b* in the space facing the first inclined surface 21*b*, and a part of the transport unit 6, that is, the driven roller 8*b* can be easily disposed in the space facing the second inclined surface 121*b*. For this reason, it becomes possible to dispose the driven roller 9*b* and the driven roller 8*b* near the nozzle plate 24, and the distance between the nozzle plate 24 and the driven roller 9*b* and the distance between the nozzle plate 24 and the driven roller 8*b* are shortened. Therefore, the distance La between the driven roller 8*b* of the first roller pair 8 and the driven roller 9*b* of the second roller pair 9 can be further shortened. Therefore, the transport error is reduced and the image quality can be improved. The driven roller 9*b* and the driven roller 8*b* can be disposed near the nozzle plate 24 without increasing the size of the case main body 20 of the case head 17 in the direction along the Z axis by providing the first inclined surface 21*b* on the first fixing portion 21 and providing the second inclined surface 121*b* on the second fixing portion 121, so that the height of the liquid ejecting head 3 can be reduced. Therefore, an increase in the size of the liquid ejecting apparatus 1 can be suppressed.

In the present embodiment, the driven roller 9*b* as the first transport roller is configured, but is not limited thereto, and the first transport roller may be a driving roller. In the present embodiment, the driven roller 8*b* as the second transport roller is configured, but is not limited thereto, and the second transport roller may be a driving roller.

The driven roller 9*b* as the first transport roller constituting the transport unit 6 overlaps the first opening surface 21*a* when viewed from the −Z direction and overlaps the first side surface 20*a* of the case main body 20 when viewed from the +Y direction. That is, the driven roller 9*b* can be easily disposed near the nozzle plate 24.

The driven roller 8*b* as the second transport roller constituting the transport unit 6 overlaps the second opening surface 121*a* when viewed from the −Z direction, and overlaps the second side surface 20*b* of the case main body 20 when viewed from the −Y direction. That is, the driven roller 8*b* can be easily disposed near the nozzle plate 24.

The transport unit 6 includes a support body 9*c* that supports a driven roller 9*b* as a first transport roller. The support body 9*c* overlaps the first inclined surface 21*b* when viewed from the −Z direction and the +Y direction. The support body 9*c* supports the rotating axis of the driven roller 9*b*. Thereby, a space for disposing the support body 9*c* on the −Z direction side of the first fixing portion 21 is secured, and the driven roller 9*b* can be brought closer to the nozzle plate 24. A support body (not shown) that supports the driven roller 8*b* as the second transport roller may be provided, and the support body may overlap the second inclined surface 121*b* when viewed from the −Z direction and the −Y direction. Accordingly, a space for disposing the support body on the −Z direction side of the second fixing portion 121 is secured, and the driven roller 8*b* can be brought closer to the nozzle plate 24.

When viewed from the direction orthogonal to the −Z direction and the +Y direction, the angle θ1 formed between the surface perpendicular to the −Z direction and the first inclined surface 21*b* is greater than 0 degrees and less than 90 degrees. Preferably, the angle θ1 is 35 degrees or more and 55 degrees or less. When the angle θ1 is smaller than 35 degrees, the space formed on the −Z direction side of the first fixing portion 21 becomes small. When the angle θ1 is greater than 55 degrees, it is necessary to move the position of the inner wall surface 17*b*1 in the −Y direction in order to increase the thickness of the surface of the first fixing portion 21 on the +Z direction side and the −Z direction side and secure the strength of the first fixing portion 21. As a result, the support surface 17*a* becomes smaller in the direction along the Y axis, and the size of the circuit substrate 22 has to be reduced. Therefore, by setting the angle θ1 to be 35 degrees or more and 55 degrees or less, a space for disposing the driven roller 9*b* can be easily secured on the −Z direction side of the first fixing portion 21. In the example of FIG. 12, the angle θ1 is about 45 degrees.

When viewed from the direction orthogonal to the −Z direction and the −Y direction, the angle θ2 formed between the surface perpendicular to the −Z direction and the second inclined surface 121*b* is greater than 0 degrees and less than 90 degrees. Preferably, the angle θ2 is 35 degrees or more and 55 degrees or less. When the angle θ2 is smaller than 35 degrees, the space formed on the −Z direction side of the second fixing portion 121 becomes small. When the angle θ2 is greater than 55 degrees, it is necessary to move the position of the inner wall surface 17*b*2 in the +Y direction in order to increase the thickness of the surface of the second fixing portion 121 on the +Z direction side and the −Z direction side and secure the strength of the second fixing portion 121. As a result, the support surface 17*a* becomes smaller in the direction along the Y axis, and the size of the circuit substrate 22 has to be reduced. Therefore, by setting the angle θ2 to be 35 degrees or more and 55 degrees or less, a space for disposing the driven roller 8*b* can be easily secured on the −Z direction side of the second fixing portion 121. In the example of FIG. 12, the angle θ2 is about 45 degrees.

The first opening surface 21*a* is disposed in the +Z direction with respect to the support surface 17*a*. By disposing the first opening surface 21*a* at a higher position with respect to the nozzle plate 24, a sufficient space for disposing the driven roller 9*b* on the −Z direction side of the first fixing portion 21 can be secured. The first opening surface 21*a* is disposed in the +Z direction from the center of the circuit substrate 22 in the −Z direction. As a result, a large space can be secured below the first opening surface 21*a*.

The second opening surface 121*a* is disposed in the +Z direction with respect to the support surface 17*a*. Since the second opening surface 121*a* is disposed at a higher position with respect to the nozzle plate 24, a sufficient space for disposing the driven roller 8*b* on the −Z direction side of the second fixing portion 121 can be secured. The second opening surface 121*a* is disposed in the +Z direction from the center of the circuit substrate 22 in the −Z direction. Accordingly, a large space can be secured below the second opening surface 121*a*.

One end 21*ba* of the first inclined surface 21*b* near the first side surface 20*a* is located between the inner wall surface 17*b*1 and the first side surface 20*a* in the direction along the Y axis. Thereby, a larger space is formed in the region facing the first inclined surface 21*b* compared to the configuration in which the one end 21*ba* is positioned in the +Y direction with respect to the inner wall surface 17*b*1, and a space for disposing the driven roller 9*b* can be secured.

The first fixing portion 21 has a connection surface 21*c* perpendicular to the −Z direction that connects the one end 21*ba* of the first inclined surface 21*b* and the first side surface 20*a*. Thereby, strength is increased because the thickness of the first inclined surface 21*b* and the support surface 17*a* is secured compared to the configuration in which the perpendicular connection surface 21*c* is not provided and the first side surface 20*a* and the one end 21*ba* of the first inclined surface 21*b* are continuous, and it can suppress that the first fixing portion 21 is being damaged.

Similarly, one end 121*ba* of the second inclined surface 121*b* near the second side surface 20*b* is located between the inner wall surface 17*b*2 and the second side surface 20*b* in the direction along the Y axis. Thereby, a larger space is formed in the region facing the second inclined surface 121*b* compared to the configuration in which the one end 121*ba* is located in the −Y direction with respect to the inner wall surface 17*b*2 and a space for disposing the driven roller 8*b* can be secured.

The second fixing portion 121 has a connection surface 121*c* perpendicular to the −Z direction that connects the one end 121*ba* of the second inclined surface 121*b* and the second side surface 20*b*. Thereby, the thickness of the case head 17 in the second inclined surface 121*b* portion is secured compared to the configuration in which the perpendicular connection surface 121*c* is not provided and the second side surface 20*b* and the one end 121*ba* of the second inclined surface 121*b* are continuous, and it can suppress that the second fixing portion 121 is being damaged.

The lid member 38 is fixed to the introduction path unit 18 via the case head 17 by the first screw 39A and the second screw 39B. The lid member 38 includes a surface 38*e* that abuts on both ends of the nozzle plate 24 in the direction along the Y axis, a surface 38*d* extending in the +Z direction from the end of the surface 38*e* on the +Y direction side, a surface 138*d* extending in the +Z direction from the end of the surface 38*e* on the −Y direction side, a surface 38*aa* that abuts on the bearing surface 39Ab of the first screw 39A, a surface 138*aa* that abuts on the bearing surface 39Bb of the second screw 39B, a third inclined surface 38*b* that is disposed between the surface 38*aa* and the surface 38*d* in the direction along the Y axis, and a fourth inclined surface 138*b* disposed between the surface 138*aa* and the surface 138*d* in the direction along the Y axis. The surface 38*d* is a surface that at least partially abuts on the first side surface 20*a* of the case main body 20, and is continuous with the end of the surface 38*e* in the +Y direction and the one end 38*c* of the third inclined surface 38*b* in the −Y direction. The surface 138*d* is a surface that at least partially abuts on the second side surface 20*b* of the case main body 20, and is continuous with the end of the surface 38*e* in the −Y direction and the one end 138*c* of the fourth inclined surface 138*b* in the +Y direction.

The surface 38*aa* of the lid member 38 that is abutting on the bearing surface 39Ab of the first screw 39A is disposed in the +Z direction with respect to the support surface 17*a*. That is, the surface 38*aa* of the lid member 38 is disposed above the support surface 17*a*. Thus, even if the case head 17 is covered with the lid member 38, the driven roller 9*b* can be disposed near the nozzle plate 24.

Similarly, the surface 138*aa* of the lid member 38 that is abutting on the bearing surface 39Bb of the second screw 39B is disposed in the +Z direction with respect to the support surface 17*a*. That is, the surface 138*aa* of the lid member 38 is disposed above the support surface 17*a*. Thus, even if the case head 17 is covered with the lid member 38, the driven roller 8*b* can be disposed near the nozzle plate 24.

The third inclined surface 38*b* is inclined to a surface perpendicular to the −Z direction so as to face the first inclined surface 21*b*. The third inclined surface 38*b* extends along the first inclined surface 21*b* and is substantially parallel to the first inclined surface 21*b*. The one end 38*c* of the third inclined surface 38*b* in the −Y direction is provided between the first side surface 20*a* and the one end 21*ba* of the first inclined surface 21*b* in the direction along the Y axis. With the above configuration, since a space can be provided on the −Z direction side of the first fixing portion 21, the driven roller 9*b* can be disposed near the nozzle plate 24. Because there is a space Sp1 formed between the first side surface 20*a* of the case main body 20 at the portion not abutting on the surface 38*d* of the lid member 38, the perpendicular connection surface 21*c* provided on the first fixing portion 21, and the third inclined surface 38*b* of the lid member 38, the ink that has entered the gap between the lid member 38 and the case head 17 and scooped upward by the capillary force can be held in the space Sp1, and the ink scooping upward from the space Sp1 can be suppressed.

Similarly, the fourth inclined surface 138*b* is inclined to a surface perpendicular to the −Z direction so as to face the second inclined surface 121*b*. The fourth inclined surface 138*b* extends along the second inclined surface 121*b* and is substantially parallel to the second inclined surface 121*b*. The one end 138*c* of the fourth inclined surface 138*b* in the +Y direction is provided between the second side surface 20*b* and one end 121*ba* of the second inclined surface 121*b* in the direction along the Y axis.

With the above configuration, a space can be provided on the −Z direction side of the second fixing portion 121, so that the driven roller 8*b* can be disposed near the nozzle plate 24. Because there is a space Sp2 formed between the second side surface 20*b* of the case main body 20 at the portion not abutting on the surface 138*d* of the lid member 38, the perpendicular connection surface 121*c* provided on the second fixing portion 121, and the fourth inclined surface 138*b* of the lid member 38, the ink that has entered the gap between the lid member 38 and the case head 17 and scooped upward by capillary force can be held in the space Sp2, and it is possible to suppress ink from climbing upward from the space Sp2.

The case head 17 protrudes in the +Z direction from the support surface 17*a* and has a flow path pipe 91 in which ink flows, and the first opening surface 21*a* and the second opening surface 121*a* are disposed in the −Z direction from a top surface 91*a* provided on the +Z direction side of the flow path pipe 91. The flow path pipe 91 is coupled to a flow path 18*a* provided in the introduction path unit 18 via a seal member 93. The seal member 93 is provided with a flow path, and the flow path 18*a* of the introduction path unit 18 and the flow path 100 in a portion defined by the flow path pipe 91 communicate with each other via the flow path of the seal member 93. The side of the flow path 18*a* provided in the introduction path unit 18 opposite to the coupling side with the seal member 93 communicates with an intermediate flow path (not shown) formed in the flow path plate 92. Thereby, since the first screw 39A and the second screw 39B are fixed from below the top surface 91*a* of the flow path pipe 91, the sealing performance between the introduction path unit 18 and the case head 17 can be improved.

The position of the −Z direction side end of the screw head 39Aa of the first screw 39A substantially coincides with the position where the support surface 17*a* is provided in the direction along the Z axis. That is, when the position of the −Z direction side end of the screw head 39Aa of the first screw 39A is greatly located on the −Z direction side with respect to the support surface 17*a*, for example, it is possible to easily secure a space for disposing the driven roller 9*b* on the −Z direction side of the first screw 39A compared to the case where it is positioned in the −Z direction with respect to the connection surface 21*c* of the first fixing portion 21. More preferably, the position of the −Z direction side end of the screw head 39Aa of the first screw 39A is located between the support surface 17*a* and the first opening surface 21*a* in the direction along the Z axis. Thereby, a space for disposing the driven roller 9*b* on the −Z direction side of the first screw 39A can be more easily secured.

Similarly, the position of the −Z direction side end of the screw head 39Ba of the second screw 39B substantially coincides with the position where the support surface 17*a* is provided in the direction along the Z axis. That is, when the position of the −Z direction side end of the screw head 39Ba of the second screw 39B is greatly located on the −Z direction side with respect to the support surface 17*a*, for example, a space for disposing the driven roller 8*b* on the −Z direction side of the second screw 39B can be easily secured compared to the case where it is positioned in the −Z direction with respect to the connection surface 121*c* of the second fixing portion 121. The position of the −Z direction side end of the screw head 39Ba of the second screw 39B is more preferably located between the support surface 17*a* and the second opening surface 121*a* in the direction along the Z axis. Thereby, a space for disposing the driven roller 8*b* on the −Z direction side of the second screw 39B can be more easily secured.

In the liquid ejecting apparatus 1, 10 nozzle rows 28 in which some of the plurality of nozzles 29 are disposed along the Y axis are configured, and the 10 nozzle rows 28 are disposed in the direction along the X axis. Even in the liquid ejecting head 3 having many nozzle rows 28, a through-hole for inserting the first screw 39A and the second screw 39B for fixing each member constituting the liquid ejecting head 3 is not provided in the circuit substrate 22 by providing each fixed portion 70 of the first fixing portion 21 and the second fixing portion 121 on both outer sides of the circuit substrate 22 in the direction along the Y axis. Therefore, the wiring layout of the circuit substrate 22 corresponding to the liquid ejecting head 3 having many nozzle rows 28 can be made dense. Since the case head 17 has the first inclined surface 21*b* and the second inclined surface 121*b*, the driven roller 9*b* and the driven roller 8*b* can be disposed near the nozzle plate 24, and it is possible to achieve high image quality while reducing the height of the liquid ejecting apparatus 1 in the height direction (the direction along the Z axis).

Modification Example 1

The first fixing portion 21 of the above embodiment has a configuration having the connection surface 21*c* perpendicular to the −Z direction in which the one end 21*ba* of the first inclined surface 21*b* and the first side surface 20*a* are continuous, but is not limited thereto. The configuration may be such that the connection surface 21*c* perpendicular to the −Z direction is omitted. That is, the first inclined surface 21*b* may be configured to be continuous with the first side surface 20*a*. In the second fixing portion 121, the second inclined surface 121*b* may be configured to be continuous with the second side surface 20*b*. Even in this case, a space for disposing the driven rollers 8*b* and 9*b* can be secured.

Modification Example 2

In the above embodiment, the first opening surface 21*a* and the second opening surface 121*a* are disposed in the +Z direction with respect to the support surface 17*a*, but is not limited thereto. For example, the first opening surface 21*a* and the second opening surface 121*a* may be disposed at the same height with respect to the support surface 17*a*. The first opening surface 21*a* and the second opening surface 121*a* may be disposed in the −Z direction with respect to the support surface 17*a*.

Modification Example 3

In the above embodiment, the driven roller 9*b* overlaps the first opening surface 21*a* when viewed from the −Z direction and overlaps the case main body 20 when viewed from the +Y direction, and the driven roller 8*b* overlaps the second opening surface 121*a* when viewed from the −Z direction and overlaps the case main body 20 when viewed from the +Y direction, but is not limited thereto. For example, one of the driven roller 9*b* and the driven roller 8*b* may be configured to satisfy the above configuration.

Modification Example 4

In the above embodiment, the first fixing portion 21 is provided with the first inclined surface 21*b*, and the second fixing portion 121 is provided with the second inclined surface 121*b*. However, the first fixing portion 21 may be provided with a first inclined surface 21*b*, and the second fixing portion 121 may not be provided with a second inclined surface 121*b*, and the first fixing portion 21 may not be provided with the first inclined surface 21*b*, and the second fixing portion 121 may be provided with the second inclined surface 121*b*. That is, even in a configuration in which an inclined surface is provided only in one of the first fixing portion 21 and the second fixing portion 121, it is possible to improve the transport accuracy and improve the image quality compared to a configuration in which no inclined surface is provided on both the first fixing portion 21 and the second fixing portion 121.

The contents derived from the embodiment will be described below.

According to an aspect of disclosure, there is provided a liquid ejecting apparatus including a liquid ejecting head that ejects liquid from a plurality of nozzles in a first direction and a transport unit that transports a medium in either a second direction orthogonal to the first direction or a third direction opposite to the second direction, in which the liquid ejecting head includes a nozzle plate provided with the plurality of nozzles, a case head provided in a fourth direction opposite to the first direction with respect to the nozzle plate, a circuit substrate supported on a support surface of the case head on the fourth direction side, a holder provided in the fourth direction with respect to the circuit substrate, and a first screw that fixes the case head and the holder, the case head includes a case main body and a first fixing portion provided in the second direction with respect to a first side surface of the case main body on the second direction side and provided with a first screw hole through which the first screw passes, and the first fixing portion includes a first opening surface in which the first screw hole opens in the first direction, and a first inclined surface provided between the first side surface and the first opening surface and inclined with respect to a surface perpendicular to the first direction.

According to this configuration, the case head is provided with the first inclined surface between the first side surface and the first opening surface. Thereby, compared to the case where there is no first inclined surface and the first fixing portion extends in a horizontal direction relative to the case main body, by forming the first inclined surface, a space is formed in a region facing the first inclined surface, and the transport unit can be disposed in the space. For this reason, a transport unit can be disposed near the nozzle plate, and the distance between the nozzle plate and the transport unit is shortened. Therefore, the transport error is reduced and the image quality can be improved.

By providing the first inclined surface on the first fixing portion, the height of the liquid ejecting head can be reduced without increasing the size of the case main body of the case head in the height direction as it becomes possible to dispose the transport unit near the nozzle plate. Therefore, an increase in the size of the liquid ejecting apparatus can be suppressed.

In the liquid ejecting apparatus, the transport unit may include a first transport roller that overlaps the first opening surface when viewed from the first direction and overlaps the case main body when viewed from the second direction.

According to this configuration, the first transport roller can be disposed near the nozzle plate.

In the liquid ejecting apparatus, the transport unit may include a support body that supports the first transport roller, and the support body may overlap the first inclined surface when viewed from the first direction and the second direction.

According to this configuration, a space for disposing the support body for the transport roller is secured, and the first transport roller can be brought close to the nozzle plate.

In the liquid ejecting apparatus, the liquid ejecting head may include a second screw that fixes the case head and the holder, the case head may include a second fixing portion provided in the third direction with respect to a second side surface of the case main body on the third direction side and provided with a second screw hole through which the second screw passes, the second fixing portion may include a second opening surface in which the second screw hole opens in the first direction, and a second inclined surface provided between the second side surface and the second opening surface and inclined with respect to the surface perpendicular to the first direction, and the transport unit may include a first transport roller that overlaps the first opening surface when viewed from the first direction and overlaps the case main body when viewed from the second direction, and a second transport roller that overlaps the second opening surface when viewed from the first direction and overlaps the case main body when viewed from the third direction.

According to this configuration, the case head is provided with the second inclined surface between the second side surface and the second opening surface. Thereby, compared to the case where there is no second inclined surface and the second fixing portion extends in the horizontal direction with respect to the case main body, by forming the second inclined surface, a space is formed in a region facing the second inclined surface, and the transport unit can be disposed in the space. For this reason, the first transport roller and the second transport roller can be disposed near the nozzle plate. Therefore, the distance between the first transport roller and the second transport roller is shortened, transport errors are reduced, and image quality can be improved.

In the liquid ejecting apparatus, the first opening surface may be disposed in the fourth direction with respect to the support surface.

According to this configuration, a sufficient space for disposing the transport unit can be secured.

In the liquid ejecting apparatus, the first opening surface may be disposed in the fourth direction from a center of the circuit substrate in the first direction.

According to this configuration, a larger space can be secured.

In the liquid ejecting apparatus, the case head may include a flow path pipe that protrudes from the support surface in the fourth direction and in which liquid flows, and the first opening surface may be disposed in the first direction from a top surface of the flow path pipe provided in the fourth direction.

According to this configuration, since the first screw is fixed from below the top surface of the flow path pipe, the sealing performance between the holder and the case head can be improved.

In the liquid ejecting apparatus, a screw head of the first screw may be located between the support surface and the first opening surface in the first direction.

According to this configuration, it is possible to easily secure a space for disposing the transport unit below the first screw.

In the liquid ejecting apparatus, an angle formed between the surface perpendicular to the first direction and the first inclined surface may be 35 degrees or more and 55 degrees or less when viewed from a direction orthogonal to the first direction and the second direction.

According to this configuration, it is possible to easily secure a space for disposing the transport unit.

In the liquid ejecting apparatus, the first fixing portion may include an inner wall surface disposed in the second direction with respect to the first side surface and the circuit substrate and extends in the fourth direction continuously from the support surface.

According to this configuration, for example, a through-hole or the like for passing the first screw through the circuit substrate is not formed, and the circuit substrate is disposed in a region partitioned by the support surface and the inner wall surface. Therefore, a sufficient wiring formation region on the circuit substrate can be secured.

In the liquid ejecting apparatus, a portion of the circuit substrate may be disposed in the second direction with respect to the first side surface.

According to this configuration, the disposal position of the circuit substrate can be ensured, and the wiring formation region in the circuit substrate can be secured.

In the liquid ejecting apparatus, the first inclined surface may be continued to the first side surface.

According to this configuration, it is easy to secure a space for disposing the transport unit.

In the liquid ejecting apparatus, one end of the first inclined surface close to the first side surface may be located between the inner wall surface and the first side surface in the second direction.

According to this configuration, it is possible to secure a space for disposing the transport unit as compared with a configuration in which one end is positioned in the second direction with respect to the inner wall surface.

In the liquid ejecting apparatus, the first fixing portion may include the surface perpendicular to the first direction that connects the one end of the first inclined surface and the first side surface.

According to this configuration, compared to the configuration in which the perpendicular surface is not provided, and the first side surface and one end of the first inclined surface are continuous, it is possible to secure the thickness of the case head at the first inclined surface portion and to prevent the first fixing portion from being damaged.

The liquid ejecting apparatus may further include a lid member provided with openings that expose the plurality of nozzles and covers the nozzle plate from the first direction, in which the lid member may be fixed to the holder by the first screw via the case head, a surface of the lid member abutted on a bearing surface of the first screw may be disposed in the fourth direction with respect to the support surface, the lid member may include a third inclined surface inclined to the surface perpendicular to the first direction so as to face the first inclined surface, and one end of the third inclined surface may be provided between the first side surface and the one end of the first inclined surface in the second direction.

According to this configuration, even in the configuration in which the lid member is provided, it is possible to have the third inclined surface along the first inclined surface and to dispose the transport unit near the nozzle plate, thereby improving the image quality. Because there is a space between the perpendicular surface provided in the first fixing portion of the case head and the third inclined surface of the lid member, the liquid that has entered the gap between the lid member and the case head and has been scooped upward by capillary force can be held in the space, and the liquid can be prevented from scooping upward from the space.

The liquid ejecting apparatus may further include a lid member provided with openings that exposes the plurality of nozzles and covers the nozzle plate from the first direction, in which the lid member may be fixed to the holder by the first screw via the case head, and a surface of the lid member abutted on a bearing surface of the first screw may be disposed in the fourth direction with respect to the support surface.

According to this configuration, even in the configuration in which the lid member is provided, it is possible to dispose the transport unit near the nozzle plate, and it is possible to improve the image quality.

In the liquid ejecting apparatus, the lid member may include a surface inclined to the surface perpendicular to the first direction so as to face the first inclined surface.

According to this configuration, it is possible to dispose the transport unit near the nozzle plate more easily, and the image quality can be improved.

The liquid ejecting apparatus may further include a carriage that holds the liquid ejecting head, in which the liquid ejecting head and the carriage may be positioned by a positioning portion provided in the holder.

According to this configuration, since the positioning with the carriage is performed by the holder provided above the case head, it is possible to suppress the reduction of the disposal space of the transport unit by the positioning portion and to improve the image quality.

In the liquid ejecting apparatus, a portion of the plurality of nozzles may constitute 10 nozzle rows disposed along the second direction, and the 10 nozzle rows may be disposed along a direction orthogonal to the first direction and the second direction.

According to this configuration, even in a liquid ejecting head having a multi-nozzle row, the wiring layout of the circuit substrate can be increased in density, and the height of the liquid ejecting apparatus can be decreased in the height direction. Furthermore, high image quality can be realized.

What is claimed is:

1. A liquid ejecting apparatus comprising:

a liquid ejecting head that ejects liquid from nozzles in a first direction; and a transport unit that transports a medium in either a second direction orthogonal to the first direction or a third direction opposite to the second direction, wherein the liquid ejecting head includes a nozzle plate provided with the nozzles, a case head provided in a fourth direction opposite to the first direction with respect to the nozzle plate, and having a support surface on the fourth direction side thereof, a circuit substrate supported on the support surface of the case head, a holder provided in the fourth direction with respect to the circuit substrate, and a first screw that fixes the case head and the holder, the case head includes a case main body having a first side surface on the second direction side thereof and a first fixing portion provided in the second direction with respect to the first side surface of the case main body, the first fixing portion provided with a first screw hole through which the first screw passes, and the first fixing portion includes a first opening surface in which the first screw hole opens in the first direction, and a first inclined surface that is located between the first side surface and the first opening surface and that inclines with respect to a surface perpendicular to the first direction, wherein the first fixing portion includes an inner wall surface that is located in the second direction with respect to the first side surface and the circuit substrate and that extends in the fourth direction continuously from the support surface.

2. The liquid ejecting apparatus according to claim 1, wherein the transport unit includes a first transport roller that overlaps the first opening surface when viewed from the first direction and that overlaps the case main body when viewed from the second direction.

3. The liquid ejecting apparatus according to claim 2, wherein the transport unit includes a support body that supports the first transport roller, and the support body overlaps the first inclined surface when viewed from the first direction and the second direction.

4. The liquid ejecting apparatus according to claim 1, wherein the liquid ejecting head includes a second screw that fixes the case head and the holder, the case main body having a second side surface on the third direction side thereof, the case head includes a second fixing portion provided in the third direction with respect to the second side surface of the case main body, the second fixing portion provided with a second screw hole through which the second screw passes, the second fixing portion includes a second opening surface in which the second screw hole opens in the first direction, and a second inclined surface that is located between the second side surface and the second opening surface and that inclines with respect to the surface perpendicular to the first direction, and the transport unit includes a first transport roller that overlaps the first opening surface when viewed from the first direction and that overlaps the case main body when viewed from the second direction, and a second transport roller that overlaps the second opening surface when viewed from the first direction and that overlaps the case main body when viewed from the third direction.

5. The liquid ejecting apparatus according to claim 1, wherein the first opening surface is located in the fourth direction with respect to the support surface.

6. The liquid ejecting apparatus according to claim 5, wherein the first opening surface is located in the fourth direction with respect to a center, in the first direction, of the circuit substrate.

7. The liquid ejecting apparatus according to claim 6, wherein the case head includes a flow path pipe that protrudes from the support surface in the fourth direction and in which liquid flows, and the first opening surface is located in the first direction with respect to a top surface of the flow path pipe in the fourth direction.

8. The liquid ejecting apparatus according to claim 1, wherein a screw head of the first screw is located between the support surface and the first opening surface in the first direction.

9. The liquid ejecting apparatus according to claim 1, wherein an angle between the surface perpendicular to the first direction and the first inclined surface is 35 degrees or more and 55 degrees or less when viewed from a direction orthogonal to the first direction and the second direction.

10. The liquid ejecting apparatus according to claim 1, wherein a part of the circuit substrate is located in the second direction with respect to the first side surface.

11. The liquid ejecting apparatus according to claim 1, wherein the first inclined surface is continued to the first side surface.

12. The liquid ejecting apparatus according to claim 1, wherein one end of the first inclined surface close to the first side surface is located between the inner wall surface and the first side surface in the second direction.

13. The liquid ejecting apparatus according to claim 12, wherein the first fixing portion includes a connection surface perpendicular to the first direction that connects the one end of the first inclined surface and the first side surface.

14. The liquid ejecting apparatus according to claim 13, further comprising:

a lid member provided with an opening that exposes the nozzles and covers the nozzle plate from the first direction, wherein the lid member is fixed to the holder by the first screw via the case head, a surface of the lid member abutted on a bearing surface of the first screw is located in the fourth direction with respect to the support surface, the lid member includes a third inclined surface inclined to the surface perpendicular to the first direction so as to face the first inclined surface, and one end of the third inclined surface is located between the first side surface and the one end of the first inclined surface in the second direction.

15. The liquid ejecting apparatus according to claim 1, further comprising:

a carriage holding the liquid ejecting head, wherein the liquid ejecting head and the carriage are positioned by a positioning portion provided in the holder.

16. The liquid ejecting apparatus according to claim 1, wherein the nozzles constitutes 10 nozzle rows, the nozzle row being constituted by being arranged a part of the nozzles in the second direction, and the 10 nozzle rows are disposed along a direction orthogonal to the first direction and the second direction.

17. A liquid ejecting apparatus comprising:

a liquid ejecting head that ejects liquid from nozzles in a first direction; and a transport unit that transports a medium in either a second direction orthogonal to the first direction or a third direction opposite to the second direction, wherein the liquid ejecting head includes a nozzle plate provided with the nozzles, a case head provided in a fourth direction opposite to the first direction with respect to the nozzle plate, and having a support surface on the fourth direction side thereof, a circuit substrate supported on the support surface of the case head, a holder provided in the fourth direction with respect to the circuit substrate, and a first screw that fixes the case head and the holder, the case head includes a case main body having a first side surface on the second direction side thereof and a first fixing portion provided in the second direction with respect to the first side surface of the case main body, the first fixing portion provided with a first screw hole through which the first screw passes, and the first fixing portion includes a first opening surface in which the first screw hole opens in the first direction, and a first inclined surface that is located between the first side surface and the first opening surface and that inclines with respect to a surface perpendicular to the first direction, wherein a lid member is provided with an opening that exposes the plurality of nozzles and covers the nozzle plate from the first direction, the lid member is fixed to the holder by the first screw via the case head, and a surface of the lid member abutted on a bearing surface of the first screw is disposed in the fourth direction with respect to the support surface, and wherein the lid member includes a surface inclined to the surface perpendicular to the first direction so as to face the first inclined surface.

* * * * *